US006597349B1

(12) United States Patent
Koyama et al.

(10) Patent No.: US 6,597,349 B1
(45) Date of Patent: Jul. 22, 2003

(54) SEMICONDUCTOR DISPLAY DEVICE AND METHOD OF DRIVING THE SAME

(75) Inventors: Jun Koyama, Kanagawa (JP); Mitsuaki Osame, Kanagawa (JP); Munehiro Azami, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/162,230

(22) Filed: Sep. 29, 1998

(30) Foreign Application Priority Data

Oct. 1, 1997 (JP) ..... 9-286098
May 11, 1998 (JP) ..... 10-146613

(51) Int. Cl.[7] ..... G09G 5/00
(52) U.S. Cl. ..... 345/204
(58) Field of Search ..... 345/204, 100, 345/94, 96, 8, 9

(56) References Cited

U.S. PATENT DOCUMENTS 5,170,158 A 12/1992 Shinya
5,643,826 A 7/1997 Ohtani et al.
5,648,277 A 7/1997 Zhang et al.
5,731,774 A * 3/1998 Fujii et al. ..... 341/144
5,801,673 A * 9/1998 Shimada et al. ..... 345/100
5,977,940 A * 11/1999 Akiyama et al. ..... 345/94

FOREIGN PATENT DOCUMENTS

JP 07-130652 5/1995
JP 07-135318 5/1995
JP 08-78329 3/1996

OTHER PUBLICATIONS

Y. Matsueda, S. Inoue, S. Takenaka, T. Ozawa, S. Fujikawa, T. Nakazawa, H. Ohshima: SID International Symposium Digest of Technical Paper, vol. 27, May 1996, pp. 21–24.
T. Morita, Y. Yamamoto, M. Itoh, H. Yoneda, Y. Yamane, S. Tsuchimoto, F. Funada and K. Awane: IEDM Technical Digest, Dec. 1995, pp. 841–843.
Y. Yamamoto, T. Morita, Y. Yamane, F. Funada, and K. Awane: Proceedings of the 15th International Display Research Conference (Asia Display 95), Oct. 1995, pp. 941–942.
J. Koyama, Y. Ogata, Y. Tanaka, S. Nakajima and S. Yamazaki: Extended Abstracts of the 1997 International Conference on Solid State Devices and Materials, Sep. 1997, pp. 348–349.
M. Osame, M. Azami, J. Koyama, Y. Ogata, H. Ohtani, S. Yamazaki, "A 2.6–in. Poly–Si TFT–LCD HDTV Display with Monolithic Integrated 8–bit Digital Data Drivers", SID 98 Digest, May 1998, pp. 1059–1062.

* cited by examiner

*Primary Examiner*—Richard Hjerpe
*Assistant Examiner*—Ronald Laneau
(74) *Attorney, Agent, or Firm*—Eric J. Robinson; Robinson Intellectual Property Law Office, P.C.

(57) ABSTRACT

In a driving circuit of a digital gradation system semiconductor display device, one D/A conversion circuit 208 is provided for a plurality of source signal lines, and the respective source signal lines are driven in a time-division manner. By this, the number of the D/A conversion circuits 208 in the driving circuit can be decreased, and miniaturization of the semiconductor display device can be achieved.

31 Claims, 21 Drawing Sheets

HEAT TREATMENT FOR CRYSTALLIZATION

GETTERING PROCESS FOR CATALYTIC ELEMENT

SEMICONDUCTOR DISPLAY DEVICE AND METHOD OF DRIVING THE SAME

BACKGROUND OF THE INVENTION

1. Field of the Invention

The present invention relates to a semiconductor display device for displaying information, such as a picture, by means of pixels arranged in matrix.

2. Description of the Related Art

In recent years, a technique for manufacturing a semiconductor device in which a semiconductor thin film is formed on an inexpensive glass substrate, such as a thin film transistor (TFT), has been rapidly developed. The reason is that a demand for an active matrix type liquid crystal display device (liquid crystal panel) has been increased.

The active matrix type liquid crystal panel is structured such that a TFT is disposed for each of several tens to several millions of pixel regions arranged in matrix, and an electric charge going in and out of the respective pixel electrodes is controlled by the switching function of the TFT.

Among them, attention comes to be paid to a digital gradation system active matrix liquid crystal display device capable of being driven at high speed.

As shown in FIG. 1, a conventional digital gradation system active matrix liquid crystal display device includes a source signal line side shift register 101, a digital decoder 102, latch circuits 103 (LAT1), latch circuits 104 (LAT2), a latch pulse line 105, D/A conversion circuits 106, source signal lines 107, a gate signal line side shift register 108, gate signal lines (scanning line) 109, pixel TFTs 110, and the like.

Digital gradation signals supplied to address lines 1 to 4 of the digital decoder 102 are written in the LAT1 by timing signals from the source signal line side shift register 101.

A time in which writing of the digital gradation signals into the LAT1 group is roughly ended, is referred to as one line period. That is, one line period is a time interval between the start point of writing of a gradation signal from the digital decoder 102 into the leftmost LAT1 in FIG. 1 and the end point of writing of a gradation signal from the digital decoder 102 into the rightmost LAT1.

After the writing of the gradation signals into the LAT1 group is ended, a latch pulse flows to the latch pulse line 105 synchronously with the operation timing of the shift register, so that the gradation signals written in the memory 1 group are transmitted all at once into the LAT2 group.

Into the LAT1 group which have finished transmission of the gradation signals into the LAT2 group, writing of gradation signals supplied to the digital decoder 102 is again sequentially carried out by a signal from the source signal line side shift register 101.

In the second one line period, according to the gradation signals transmitted to the LAT2 group synchronously with the start of the second one line period, gradation voltages are selected by the D/A conversion circuits (digital/analog conversion circuits) 106.

The selected gradation voltages are supplied to the corresponding source signal lines in one line period.

By repeating the above-mentioned operation, images are supplied to the entire of the pixel portions of the liquid crystal display device.

However, in the case of the foregoing digital gradation liquid crystal display device, the area of the D/A conversion circuit is actually rather large as compared with other circuits, which hinders miniaturization of the liquid crystal display device requested in recent years.

In recent years, with the rapid increase of the amount of information to be treated, it has been designed to increase the display capacity (display resolution) and to make display resolution fine. However, with the increase of the display capacity, the number of D/A conversion circuits is also increased, so that reduction of an area of a driving circuit portion is earnestly desired.

Here, examples of generally used display resolution of a computer will be shown below with the number of pixels and the name of standard.

Number of pixels (Horizontal×Vertical): Name of standard

640×400: EGA

640×480: VGA

800×600: SVGA

1024×768: XGA

1280×1024: SXGA

For example, in the case where the XGA standard (1024×768 pixels) is cited as an example, in the foregoing driving circuit, a D/A converter is required for each of 1024 signal lines.

Recently, also in the field of a personal computer, since software for causing a plurality of presentations with different characters to be shown on a display has come into wide use, a display device corresponding to the XGA or SXGA standard with resolution higher than the VGA or SVGA standard becomes common.

Moreover, the above-mentioned liquid crystal display device having high resolution comes to be used also as display of a television signal other than display of a data signal in a personal computer.

In recent years, in order to realize a beautiful picture quality as in a high definition TV (HDTV) or an extended definition TV (EDTV), image data for one picture becomes several times that of a conventional TV. Moreover, since the easiness of viewing is improved and it becomes possible to display a plurality of pictures on one display device by enlarging a screen, a large screen and high gradation comes to be increasingly required.

As the standard of display resolution of a TV (ATV) for a future digital broadcast, the standard of 1920×1080 pixels is promising, and the reduction of an area of a driving circuit portion is rapidly demanded.

However, as described above, since an occupied area of a D/A conversion circuit is large, as the number of pixels increases, the area of the driving circuit portion becomes remarkably large, which hinders the miniaturization of a liquid crystal display device.

SUMMARY OF THE INVENTION

The present invention has been made in view of the foregoing problems, and an object of the present invention is therefore to provide a small semiconductor display device, especially a liquid crystal display device by decreasing an occupied area of D/A conversion circuits in a driving circuit portion.

According to an aspect of the present invention, a semiconductor display device comprises a D/A conversion circuit portion including a plurality of D/A conversion circuits, and each of the plurality of D/A conversion circuits sequentially makes analog conversion of digital gradation signals supplied from a memory circuit. The above object is achieved by this device.

The memory circuit may include a plurality of latch circuits.

According to another aspect of the present invention, a semiconductor display device comprises a memory circuit for storing m x-bit digital gradation signals (m and x are natural numbers), and a D/A conversion circuit portion for making analog conversion of the m x-bit digital gradation signals supplied from the memory circuit and for supplying analog signals to m source signal lines, the D/A conversion circuit portion includes n D/A conversion circuits (n is a natural number), and each of the n D/A conversion circuits sequentially makes analog conversion of the m/n x-bit digital gradation signals to supply converted signals to corresponding m/n source signal lines. The above object is achieved by this device.

The memory circuit may include a plurality of latch circuits.

According to still another aspect of the present invention, a method of driving a semiconductor display device comprises the steps of storing m x-bit digital gradation signals (m and x are natural numbers) for one line, and sequentially making analog conversion of the m/n x-bit digital gradation signals in one line period by each of n D/A conversion circuits (n is a natural number) to transmit converted signals to corresponding m/n source signal lines. The above object is achieved by this method.

According to yet another aspect of the present invention, a method of driving a semiconductor display device comprises the steps of sampling and storing m x-bit digital gradation signals by a timing signal from a shift register (m and x are natural numbers), and sequentially making analog conversion of the m/n x-bit digital gradation signals by each of n D/A conversion circuits (n is a natural number) to transmit gradation voltages to corresponding m/n source signal lines. The above object is achieved by this method.

A Japanese Patent Application No.9-344351 discloses a D/A conversion circuit the disclosure of which is incorporated herein by reference. Further, a Japanese Patent Application No.9-365054 discloses a D/A conversion circuit and a semiconductor device the disclosure of which is incorporated herein by reference. Furthermore, a Japanese Patent Application No. 10-100638 discloses a semiconductor display device and a driving circuit for a semiconductor display device the disclosure of which is incorporated herein by reference.

DETAILED DESCRIPTION OF THE PREFERRED EMBODIMENTS

Embodiment 1

In this embodiment, in a driving circuit (driver) at a source signal line side, one D/A conversion circuit is provided for every four source signal lines, so that an area occupied by the D/A conversion circuits in the driving circuit can be decreased.

Figure 2:
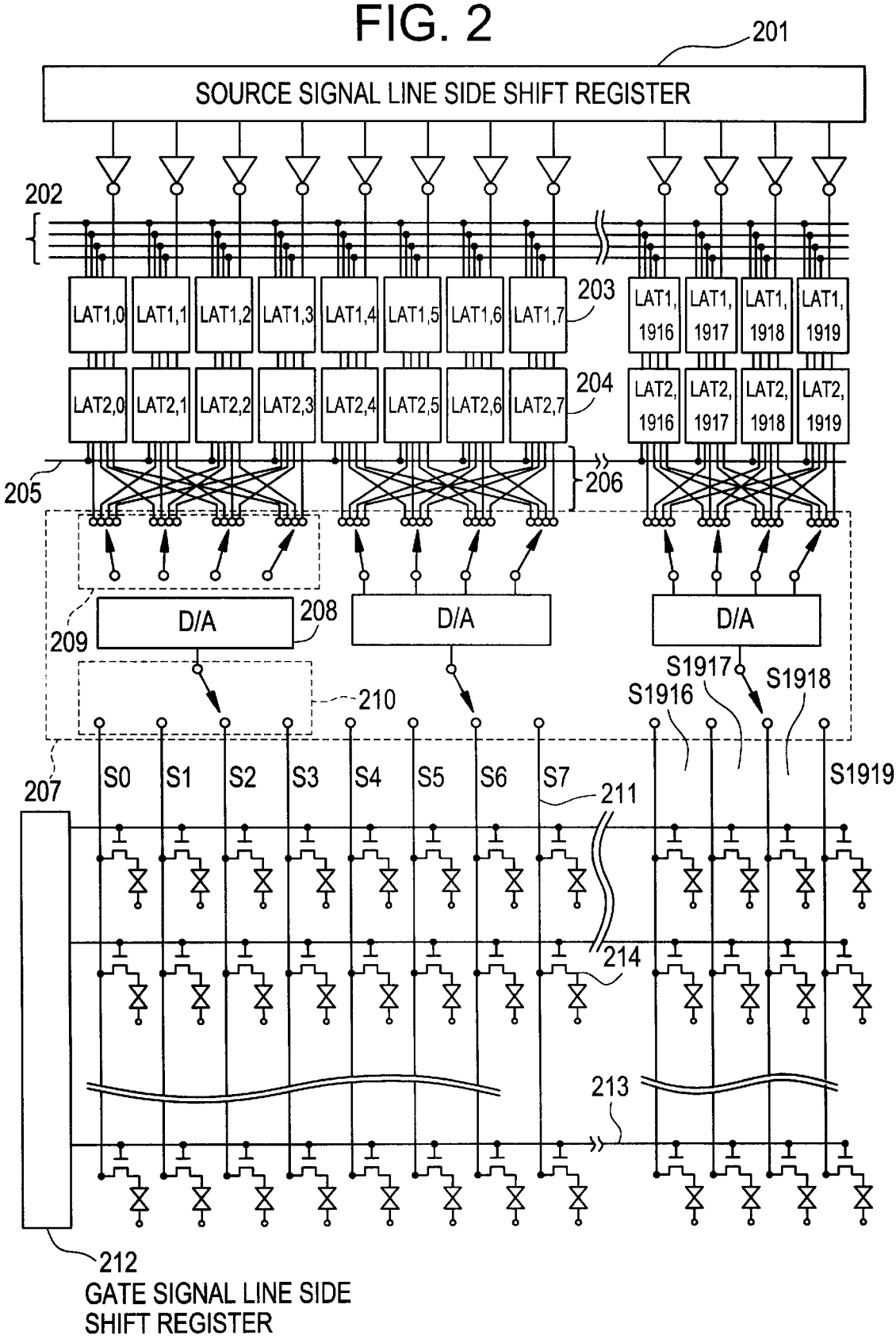
FIG. 2 is a schematic view showing a semiconductor display device according to an embodiment of the present invention.

In this embodiment, explanation will be made to a liquid crystal display device having display resolution of 1920× 1080 as an example. Reference will be made to FIG. 2. FIG. 2 is a schematic view of a liquid crystal display device of this embodiment. Reference numeral 201 denotes a source signal line side shift register, 202 denotes an address decoder which supplies digital gradation signals to latch circuits 203 (LAT1.0 to LAT1.1919). In this embodiment, although the driving circuit for 4-bit digital gradation is cited as an example, the present invention is not limited to this, but can be applied to a 6-bit, 8-bit, or other digital gradation driving circuit.

Reference numeral 204 denotes latch circuits (LAT2.0 to LAT2.1919), which stores data transmitted from the LAT1 group LAT1.0 to LAT1.1919 all at once on the basis of a latch pulse from a latch pulse line 205. Signal lines 206 supply gradation signals from the LAT2 group LAT2.0 to LAT2.1919 to a lower stage. In this embodiment, since a 4-bit digital gradation signal is processed, the four signal lines 206 are extended from each of the LAT2 group. Although reference characters are sequentially given to the signal lines 206, they are omitted in FIG. 2.

Figure 14:
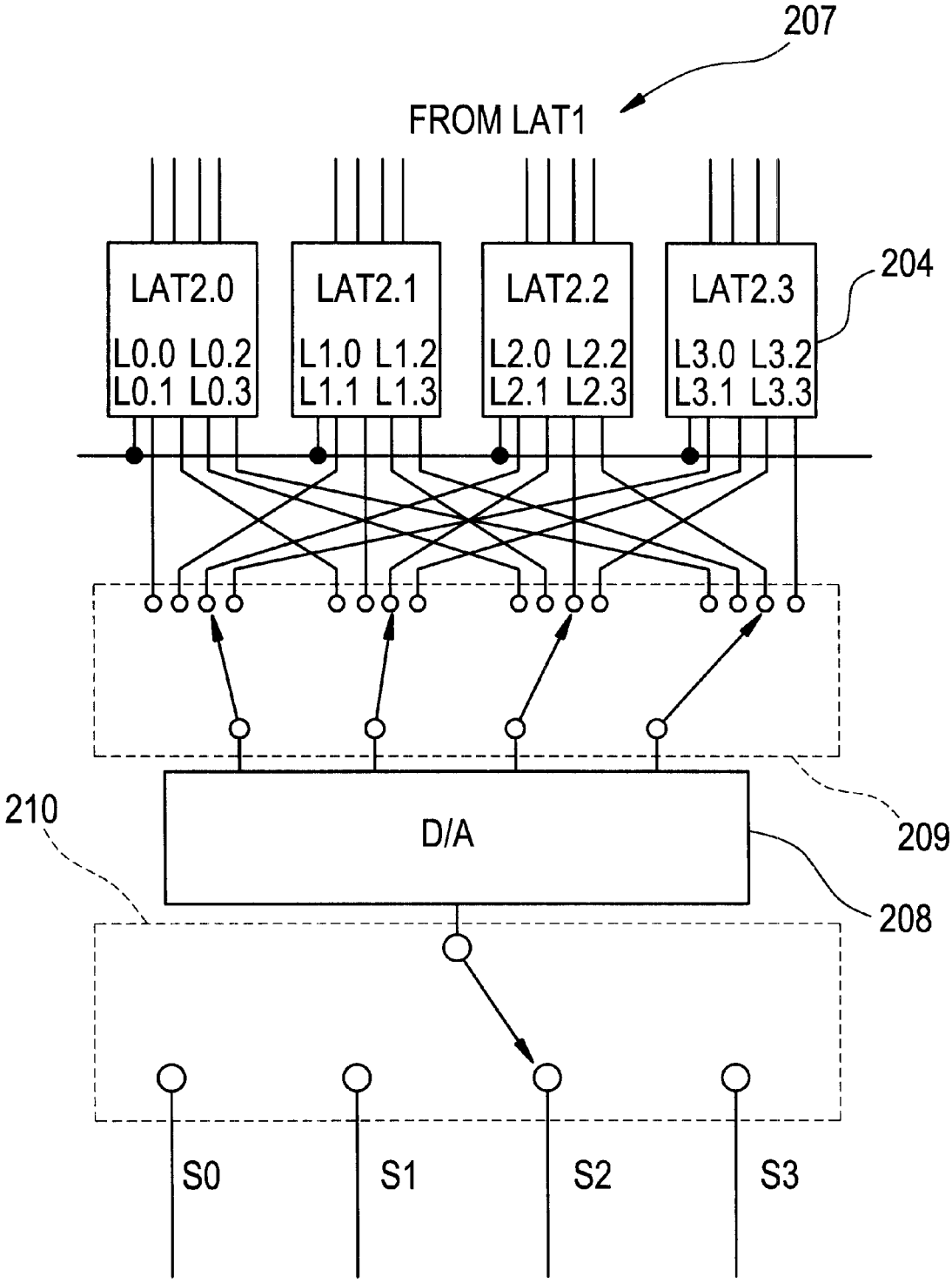
FIG. 14 is a partial structural view of a semiconductor display device according to an embodiment of the present invention.

FIG. 14 shows circuits from the LAT2 group to source signal lines 211 in FIG. 2 while paying attention to the leftmost D/A conversion circuit 208. It is understood that the reference characters L0.0 to L3.3 are given to the signal lines 206. In the reference character La.b designating the signal line 206, "a" indicates the number of a latch circuit in the LAT2 group, and "b" indicates the number of a bit from an upper bit to a lower bit according to 0 to 3.

Similarly, all signal lines are given reference characters of L0.0 to L1919.3.

A portion (broken line portion) denoted by 207 is a D/A conversion portion which includes D/A conversion circuits 208, switch circuits 209 (broken line portions), and switch circuits 210 (broken line portions). Reference numeral 211 denotes source signal lines which are given reference characters of S0 to S1919.

In the D/A conversion portion 207, one D/A conversion circuit 208 is provided for every four latch circuits of the LAT2 group (that is, for every sixteen lines of the signal lines L0.0 to L1919.3 connected to the LAT2 group LAT2.0 to LAT2.1919) and for every four lines of the signal lines S0 to S1919. Thus, in this embodiment, 480 (=1920/4) D/A conversion circuits 208 are provided. In FIG. 2, the switch circuit 209 connected to the leftmost D/A conversion circuit 208 sequentially selects bit signals from one latch circuit among four latch circuits of the LAT2 group. The switch circuit 210 selects one of the source signals S0 to S3.

Reference numeral 212 denotes a gate signal line side shift register which supplies scanning signals to scanning lines 213. Reference numeral 214 denotes pixel TFTs, each of which constitutes a pixel together with an electrode, a liquid crystal material, and the like.

Next, an operation of the semiconductor display device of this embodiment will be described.

First, digital gradation signals are sequentially written into the LAT1 group from the digital decoder 202 by timing signals from the source signal line side shift register 201.

Figure 1:
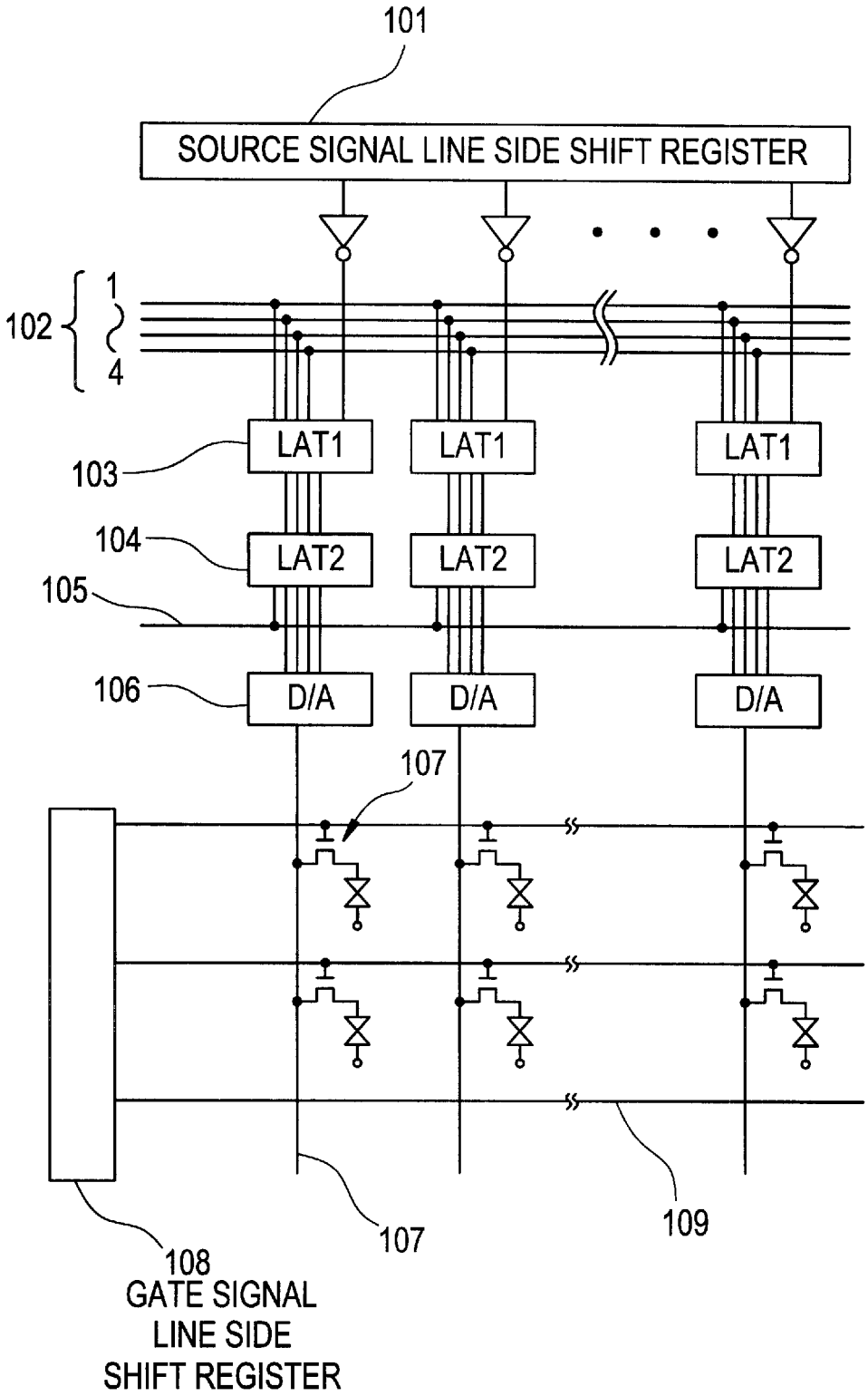
FIG. 1 is a schematic view showing a conventional digital gradation semiconductor display device.

A time in which writing of the digital gradation signals into the LAT1 group is roughly ended is one line period. That is, one line period is a time interval between the start point of writing of a gradation signal from the digital decoder into the leftmost latch circuit LAT1.0 in FIG. 1 and the end point of writing of a gradation signal from the digital decoder into the rightmost latch circuit LAT1.1919.

After the writing of the gradation signals into the LAT1 group is ended, the gradation signals written in the LAT1 group are transmitted all at once to the LAT2 group synchronously with a latch pulse supplied to the latch pulse line 205. The LAT2 group store the gradation signals and transmit the gradation signals to the signal lines 206.

Into the LAT1 group which have finished the transmission of the gradation signals to the LAT2 group, writing of gradation signals supplied to the digital decoder 202 is again sequentially carried out by signals from the source signal line side shift register 201.

Next, description will be made to an operation that the gradation signals supplied to the signal lines 206 are sequentially converted into gradation voltages by the D/A conversion circuit portion 207 and are transmitted to the source signal lines S0 to S1919, while using the leftmost switch circuit 209, D/A conversion circuit 208, and switch circuit 210 in FIG. 2 as an example.

Reference will be made to FIG. 14 again. During one period in which gradation signals are again sequentially written into the LAT1 group, one line period is divided into four portions in the D/A conversion portion 207, four switches of the switch circuit 209 are sequentially connected to signal lines L0.0 to L0.3, L1.0 to L1.3, L2.0 to L2.3, and L3.0 to L3.3, and the switch circuit 210 is sequentially connected to the source signal lines S0 to S3. That is, in the first fourth line period, the four switches of the switch circuit 209 simultaneously selects the signal lines L0.0 to L0.3 from the latch circuit LAT2.0, and the switch circuit 210 selects the source signal line S0. During this, four bits of the gradation signals supplied to the latch circuit LAT2.0 are inputted into the D/A conversion circuit 208 at the same time, and after the gradation signals are converted into analog gradation voltages by the D/A conversion circuit 208, the gradation voltages are transmitted to the source signal line S0. On the other hand, although the gradation signals continue to be supplied to the signal lines L1.0 to L3.3 from the latch circuits LAT2.1 to LAT2.3, the switch circuit 209 does not select the signal lines L1.0 to L3.3. During this, the switch circuit 210 does not select the source signal lines S1 to S3.

Next, during the next fourth line period, four switches of the switch circuit 209 select the signal lines L1.0 to L1.3 from the latch circuit LAT2.1 at the same time, and the switch circuit 210 selects the source signal line S1. During this, the gradation signals supplied to the latch circuit LAT2.1 is converted into gradation voltages by the D/A conversion circuit 208, and then, the gradation voltages are transmitted to the source signal line S1. On the other hand, during this, the gradation signals continue to be supplied to the signal lines L0.0 to L0.3, L2.0 to L2.3, and L3.0 to L3.3 from the latch circuits LAT2.0, LAT2.2, and LAT2.3, the switch circuit 209 does not select the signal lines L0.0 to L0.3, L2.0 to L2.3, and L3.0 to L3.3. During this, the switch circuit 210 does not select the source signal lines S0, S2 and S3.

Further, during the next fourth line period, four switches of the switch circuit 209 select the signal lines L2.0 to L2.3 from the latch circuit LAT2.2 at the same time, and the switch circuit 210 selects the source signal line S2. During this, the gradation signals supplied to the latch circuit LAT2.2 is converted into gradation voltages by the D/A conversion circuit 208, and then, the gradation voltages are transmitted to the source signal line S2. On the other hand, during this, the gradation signals continue to be supplied to the signal lines L0.0 to L.0,3, L.1,0 to L1.3, and L3.0 to L3.3 from the latch circuits LAT2.0, LAT2.1, and LAT2.3, the switch circuit 209 does not select the signal lines L0.0 to L0.3, L1.0 to L1.3, and L3.0 to L3.3. During this, the switch circuit 210 does not select the source signal lines S0, S1 and S3.

Further, during the next fourth line period (that is, the last fourth line period of the one line period), four switches of the switch circuit 209 select the signal lines L3.0 to L3.3 from the latch circuit LAT2.3 at the same time, and the switch circuit 210 selects the source signal line S3. During this, the gradation signals supplied to the latch circuit LAT2.3 are converted into gradation voltages by the D/A conversion circuit 208, and then, the gradation voltages are transmitted to the source signal line S3. On the other hand, during this, the gradation signals continue to be supplied to the signal lines L0.0 to L0.3, L1.0 to L1.3, and L2.0 to L2.3 from the latch circuits LAT2.0 to LAT2.2, the switch circuit 209 does not select the signal lines L0.0 to L0.3, L1.0 to L1.3, and L2.0 to L2.3. During this, the switch circuit 210 does not select the source signal lines S0 to S2.

By the foregoing operation, the gradation voltages are transmitted to the source signal lines S0 to S3 sequentially for every fourth line period. Voltages are sequentially applied to pixel TFTs by the gradation voltages transmitted to the source signal lines and scanning signals supplied to the scanning line 213 from the gate signal line side shift register 212, and the pixels are switched.

The foregoing operation is carried out for every four of the latch circuits LAT2.0 to LAT2.1919 at the same time.

When transmission of the gradation voltages to the source signal lines in one line period is ended, writing of new gradation signals into the LAT1 group is ended, so that the gradation signals written in the LAT1 group are again all at once transmitted to the LAT2 group by a latch pulse from the latch pulse line 205. The LAT2 group store new gradation signals, and continue to supply the gradation signals to the signal lines 206.

Then, as described above, the switch circuits 209 and the switch circuits 210 start to select the signal lines L0.0 to L3.3 of the signal lines 206 and the source signal lines S0 to 1919.

Figure 3:
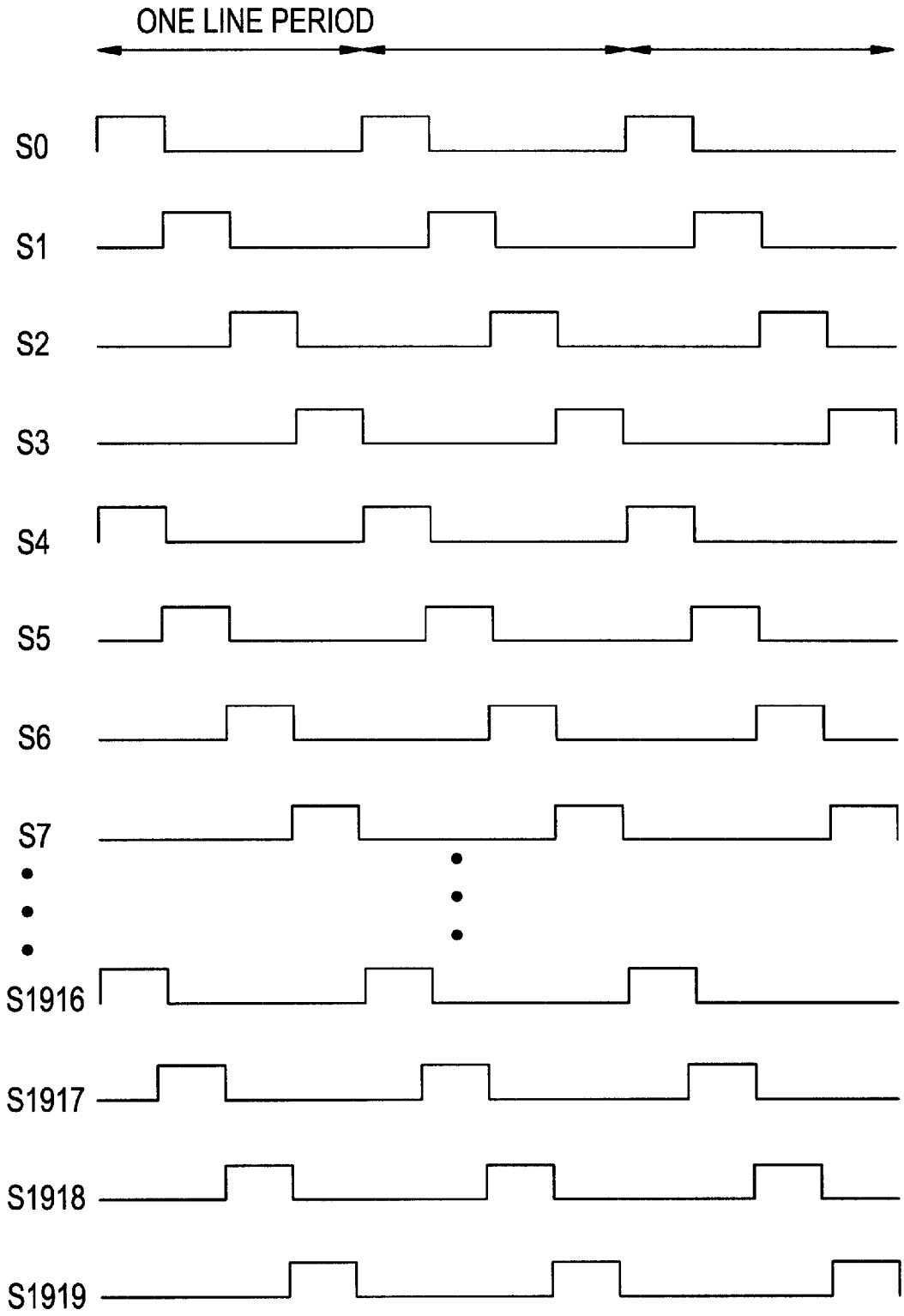
FIG. 3 is a timing chart of a source signal line of a semiconductor display device according to an embodiment of the present invention.

FIG. 3 shows timing of data transmitted to the source signal lines S0 to S1919. Although analog gradation voltages are actually applied to the source signal lines S0 to S1919, FIG. 3 shows only the timing when the gradation voltages are applied.

The foregoing operation is performed for all selected scanning lines to form a picture of one screen. This formation of one picture is performed 60 times a second.

Figure 4:
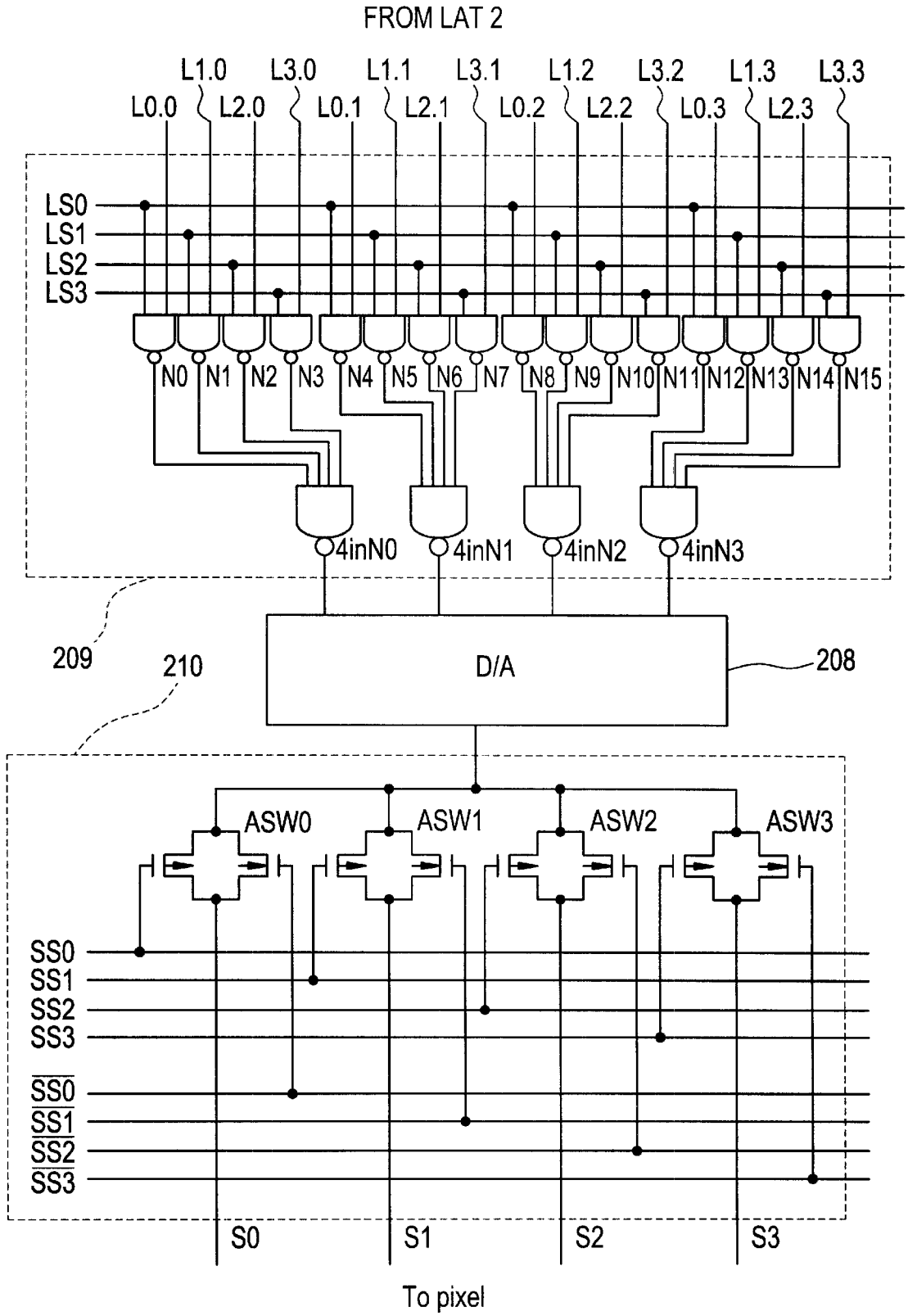
FIG. 4 is a structural view of a D/A conversion portion according to an embodiment of the present invention.

Here, a circuit structure of the D/A conversion portion 207 will be described with reference to FIG. 4. For convenience of explanation, although FIG. 2 shows only the leftmost switching circuit 209, D/A conversion circuit 208, and switching circuit 210, 480 circuits each having the same structure as that shown in FIG. 4 are provided. Besides, for convenience of explanation, the switch circuit 209 is expressed by logical circuit symbols. Since a well known D/A conversion circuit may be used for the D/A conversion circuit 208, its explanation is omitted here.

The switch circuit 209 includes four signal lines LS0 to LS3, sixteen 2-input NAND circuits (N0 to N15), and four 4-input NAND circuits (4inN0 to 4inN3). The switch circuit 210 includes eight signal lines SS0 to SS3 and inversion SS0 to inversion SS3, and four analog switches (ASW0 to ASW3) each constituted by an N-channel TFT and a P-channel TFT. Inversion signals of signals transmitted to the signal lines SS0 to SS3 are transmitted to the signal lines inversion SS0 to inversion SS3.

As shown in FIG. 4, the signal lines L0.0 to L3.3 from the LAT2 group and the signal lines LS0 to LS3 are inputted to the 2-input NANDs (N0 to N15). The outputs of these sixteen 2-input NANDs are inputted to the four 4-input NANDs (4inN0 to 4inN3).

The outputs of the four 4-input NANDs are inputted to the D/A conversion circuit 208.

The output from the D/A conversion circuit 208 is inputted into the four analog switches (ASW0 to ASW3). The four analog switches are controlled by signals from the signal lines SS0 to SS3 and inversion SS0 to inversion SS3.

The foregoing structure is provided for every four of all the latch circuits LAT2 (LAT2.0 to LAT2.1919).

Figure 5:
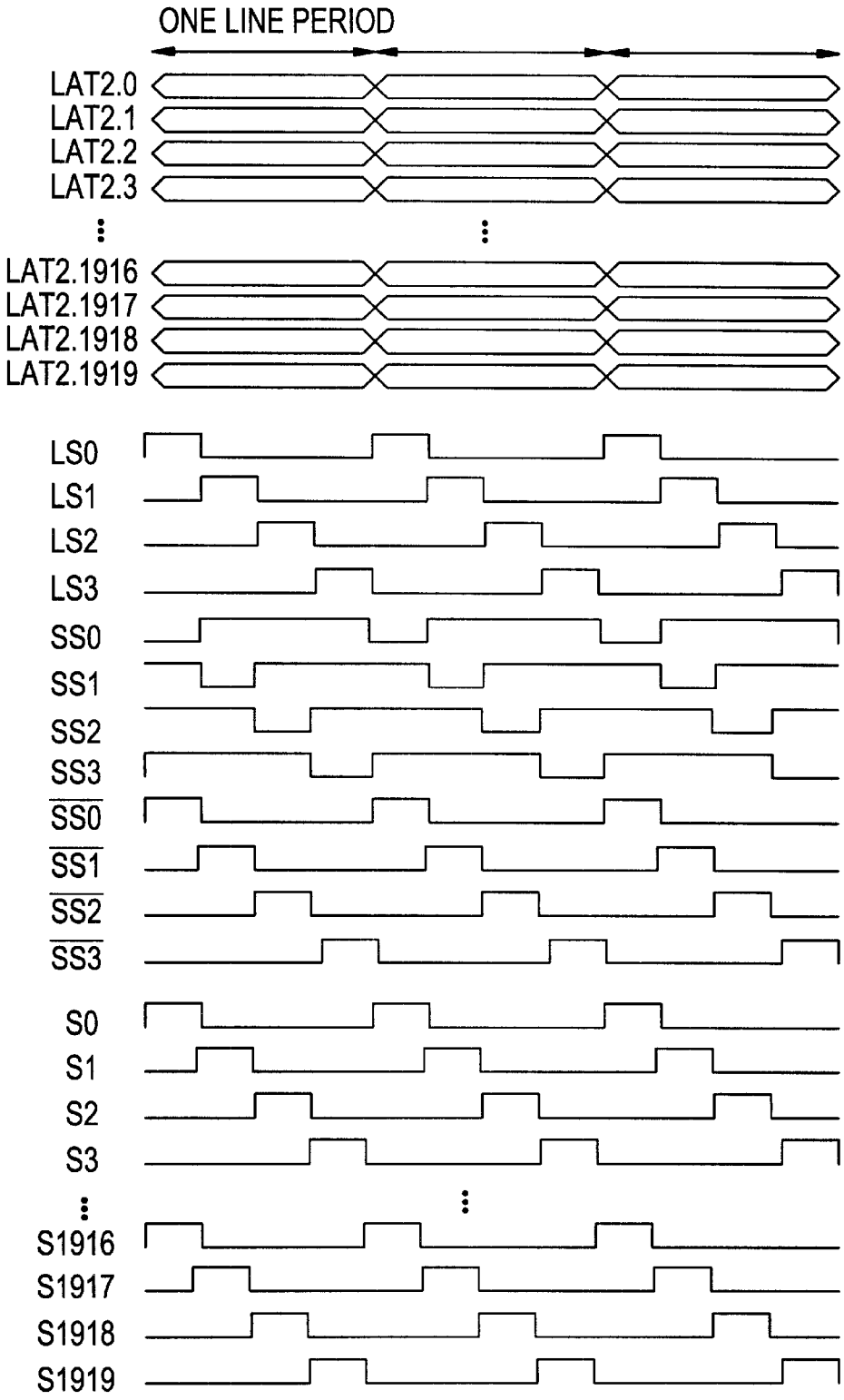
FIG. 5 is a timing chart of a D/A conversion portion according to an embodiment of the present invention.

FIG. 5 shows a timing chart of signals inputted into the respective signal lines. The 4-bit digital gradation signals are inputted into the LAT2 group (LAT2.0 to LAT2.1919). The gradation signals inputted into the LAT2 group are rewritten into new gradation signals for every one line period.

Since a Hi signal is inputted to the signal lines LS0 to LS3 sequentially for every fourth line period, the 4-bit digital gradation signals supplied to the LAT2 group are inputted into the D/A conversion circuit 208 sequentially for every fourth line period.

The digital gradation signals inputted into the D/A conversion circuit 208 are converted into analog gradation voltages and the gradation voltages are inputted into the lower analog switches ASW0 to ASW3. The analog switches ASW0 to ASW3 are controlled by the signal lines SS0 to SS3 and their conversion signal lines SS0 to SS3. By sequentially opening the analog switches ASW0 to ASW3, the gradation voltages are sequentially supplied to the source signal lines S0 to S3 for every fourth line period.

The foregoing operation is carried out for all the gradation signals from the LAT2 group, and the gradation voltages are transmitted to all the corresponding source signal lines. Although the analog gradation voltages are actually applied to the source signal lines S0 to S1919, FIG. 3 shows only the timing when the gradation voltages are supplied.

In this way, turning on of pixel TFTs for one line is carried out. The above operation is carried out for all selected scanning lines (1080 lines) so that a picture of one screen (one frame) is formed. This formation of one screen is performed 60 times a second.

In this embodiment, since the formation of one screen is performed 60 times a second, one frame period is 1/60=16.7 msec. One line period is 1/60/1080=15.4 $\mu$sec, and the period of driving the respective pixels is 1/60/1080/4=3.86 $\mu$sec. The characteristics required for the pixel TFT capable of realizing such high speed driving is a carrier mobility of 30 $cm^2/Vs$ or more. In embodiment 2 described below, a method of manufacturing a semiconductor device which can realize such a high performance TFT will be described.

According to the driving circuit of this embodiment, since the number of D/A conversion circuits occupying a large area in the driving circuit can be made one fourth of that in a conventional driving circuit, even if the increase of switch circuits is taken into consideration, it is possible to realize miniaturization of a semiconductor display device.

In this embodiment, although the number of D/A conversion circuits is made one fourth of that in a conventional driving circuit, in the present invention, the number of D/A conversion circuits may be changed to other number. For example, in the case where one D/A conversion circuit is assigned to eight source signal lines, in the semiconductor display device of this embodiment, the number of D/A conversion circuits becomes 240, so that the further reduction of the area of the driving circuit can be realized. Like this, it is not limited to this embodiment how many source signal lines are assigned one D/A conversion circuit.

Thus, in the case where the semiconductor display device of the present invention has m source signal lines (m is a natural number) (in other words, in the case where the number of pixels (horizontal×vertical) is m×arbitrary number), m x-bit digital gradation signals (x is a natural number) are supplied for one line. In this case, if the semiconductor display device of the present invention includes a D/A conversion circuit portion having n D/A conversion circuits (n is a natural number), the respective D/A conversion circuits sequentially convert m/n digital gradation signals into analog signals, and supply the analog signals to the corresponding m/n source lines. It is appropriate to use the D/A conversion circuits corresponding to the number of bits of the digital gradation signal.

Embodiment 2

In this embodiment, a method of manufacturing a liquid crystal display device having a driving circuit used in the embodiment 1 will be described.

In this embodiment, an example in which a plurality of TFTs are formed on a substrate having an insulating surface, and a pixel matrix circuit and a peripheral circuit including a driving circuit are monolithically formed, will be described with reference to FIGS. 6 to 9. In this embodiment, a CMOS circuit as a basic circuit will be shown as an example of the peripheral circuit such as a driving circuit. In this embodiment, although manufacturing steps of the circuit in which a P-channel TFT and an N-channel TFT respectively include one gate electrode will be described, a CMOS circuit composed of TFTs each including a plurality of gate electrodes, such as a double gate type, can also be manufactured in the same way.

Reference will be made to FIGS. 6A to 6D. First, a quartz substrate 601 is prepared as a substrate having an insulating surface. Instead of the quartz substrate, a silicon substrate on which a thermal oxidation film is formed may be used. Moreover, such a method may be adopted that an amorphous silicon film is temporarily formed on a quartz substrate and the film is completely thermally oxidized to form an insulating film. In addition, a quartz substrate, a ceramic substrate, or a silicon substrate, each having a silicon nitride film formed as an insulating film, may be used.

Reference numeral 602 denotes an amorphous silicon film, and adjustment is made so that a final film thickness (film thickness determined after paying consideration to a film decrease subsequent to thermal oxidation) becomes 10 to 75 nm (preferably 15 to 45 nm). In the film formation, it is important to thoroughly manage the concentration of impurities in a film.

In the film formation of the amorphous silicon film, the thorough management of the concentration of impurities in the amorphous film is important. In the case of this embodiment, management is made so that the concentration of each of C (carbon) and N (nitrogen), which are impurities to block crystallization in the amorphous silicon film 602, becomes less than $5\times10^{18}$ atoms/cm$^3$ (typically, $5\times10^{17}$ atoms/cm$^3$ or less, preferably $2\times10^{17}$ atoms/cm$^3$), and the concentration of O (oxygen) becomes less than $1.5\times10^{19}$ atoms/cm$^3$ (typically $1\times10^{18}$ atoms/cm$^3$ or less, preferably $5\times10^{17}$ atoms/cm$^3$). If the concentration of any one of the impurities exceeds the above value, the impurity may have a bad influence at subsequent crystallization and may cause a film quality to be degraded after the crystallization. In the present specification, the foregoing concentration of the impurity in the film is defined as a minimum value in measurement results of the SIMS (Secondary Ion Mass Spectroscopy).

In order to obtain the above structure, it is desirable to periodically carry out dry cleaning of a low pressure CVD furnace using in this embodiment to make a film growth chamber clean. It is appropriate that the dry cleaning of the film growth chamber is carried out by flowing a $ClF_3$ (chlorine fluoride) gas of 100 to 300 sccm into the furnace heated up to about 200 to 400° C. and by using fluorine produced by pyrolysis.

According to the knowledge of the present inventors, in the case where the temperature in the furnace is made 300° C. and the flow of the $ClF_3$ (chlorine fluoride) gas is made 300 sccm, it is possible to completely remove an incrustation (containing silicon as the main ingredient) with a thickness of 2 $\mu$m in four hours.

The concentration of hydrogen in the amorphous silicon film 602 is also a very important parameter, and it appears that as the hydrogen content is made low, a film with superior crystallinity is obtained. Thus, it is preferable to form the amorphous silicon film 602 by a low pressure CVD method. A plasma CVD method may also be used if film forming conditions are optimized.

Next, the amorphous silicon film 602 is crystallized. A technique disclosed in Japanese Patent Unexamined Publication No. Hei. 7-130652 is used as a means for crystallization.

Although both means of embodiment 1 and embodiment 2 disclosed in the publication may be used, in this embodiment, it is preferable to use the technical content (described in detail in Japanese Patent Unexamined Publication No. Hei. 8-78329) set forth in the embodiment 2 of the publication.

According to the technique disclosed in Japanese Patent Unexamined Publication No. Hei. 8-78329, a mask insulating film 603 for selecting an added region of a catalytic element is first formed. The mask insulating film 603 has a plurality of openings for addition of the catalytic element. Positions of crystal regions can be determined by the positions of the openings.

Figure 6A:
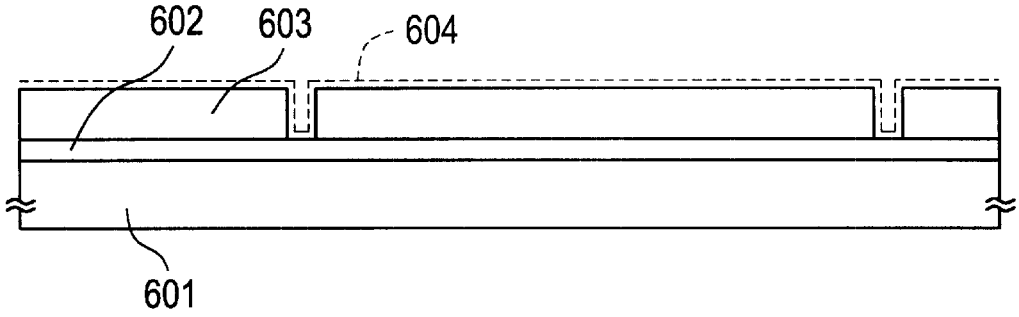
FIGS. 6A to 6D are views showing manufacturing steps of a semiconductor display device according to an embodiment of the present invention.

A solution containing nickel (Ni) as the catalytic element for facilitating the crystallization of the amorphous silicon film is applied by a spin coating method to form an Ni containing layer 604. As the catalytic element, cobalt (Co), iron (Fe), palladium (Pd), germanium (Ge), platinum (Pt), copper (Cu), gold (Au), or the like may be used other than nickel (FIG. 6A).

As the foregoing adding step of the catalytic element, an ion implantation method or a plasma doping method using a resist mask may also be used. In this case, since it becomes easy to decrease an occupied area of an added region and to control a growth distance of a lateral growth region, the method becomes an effective technique when a minute circuit is formed.

Next, after the adding step of the catalytic element is ended, dehydrogenating is carried out at about 450° C. for 1 hour, and then, a heat treatment is carried out in an inert gas atmosphere, a hydrogen atmosphere, or an oxygen atmosphere at a temperature of 500 to 700° C. (typically 550 to 650° C.) for 4 to 24 hours to crystallize the amorphous silicon film 602. In this embodiment, a heat treatment is carried out in a nitrogen atmosphere, at 570° C., and for 14 hours.

Figure 6B:
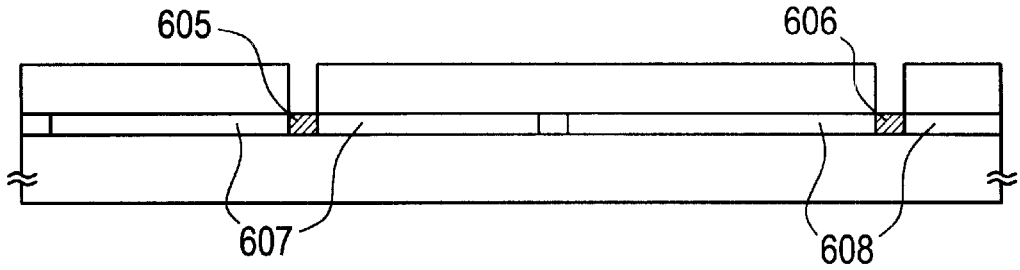

At this time, crystallization of the amorphous silicon film 602 progresses first from nuclei produced in regions 605 and 606 added with nickel, and crystal regions 607 and 608 grown almost parallel to the surface of the substrate 601 are formed. The crystal regions 607 and 608 are respectively referred to as a lateral growth region. Since respective crystals in the lateral growth region are gathered in a comparatively uniform state, the lateral growth region has such an advantage that the total crystallinity is superior (FIG. 6B).

Incidentally, even in the case where the technique set forth in embodiment 1 of the above-mentioned Japanese Patent Unexamined Publication No. Hei. 7-130652 is used, a region which can be called a lateral growth region is microscopically formed.

However, since production of nuclei occurs irregularly in the surface, it is difficult to control crystal grain boundaries.

Figure 6C:
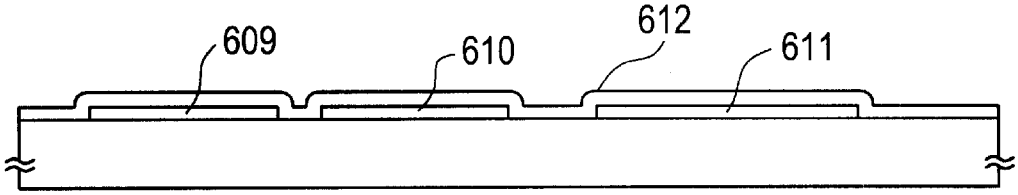

After the heat treatment for crystallization is ended, the mask insulating film 603 is removed and patterning is carried out, so that island-like semiconductor layers (active layers) 609, 610, and 611 made of the lateral growth regions 607 and 608 are formed (FIG. 6C).

Here, reference numeral 609 denotes the active layer of the N-type TFT constituting the CMOS circuit, 610 denotes the active layer of the P-type TFT constituting the CMOS circuit, and 611 denotes the active layer of the N-type TFT (pixel TFT) for constituting the pixel matrix circuit.

After the active layers 609, 610 and 611 are formed, a gate insulating film 612 made of an insulating film containing silicon is formed thereon.

Figure 6D:
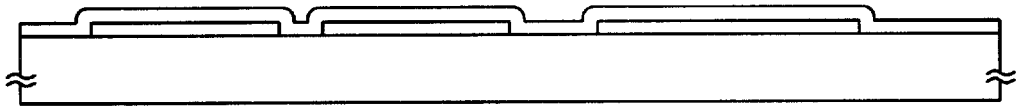

Next, as shown in FIG. 6D, a heat treatment (gettering process for the catalytic element) for removing or reducing the catalytic element (nickel) is carried out. In this heat treatment, a halogen element is made contained in a processing atmosphere and the gettering effect for a metallic element by the halogen element is used.

In order to sufficiently obtain the gettering effect by the halogen element, it is preferable to carry out the above heat treatment at a temperature exceeding 700° C. If the temperature is not higher than 700° C., it becomes difficult to decompose a halogen compound in the processing atmosphere, so that there is a fear that the gettering effect can not be obtained.

Thus, in this embodiment, the heat treatment is carried out at a temperature exceeding 700° C., preferably 800 to 1000° C. (typically 950° C.), and a processing time is made 0.1 to 6 hours, typically 0.5 to 1 hour.

In this embodiment, there is shown an example in which a heat treatment is carried out in an oxygen atmosphere containing hydrogen chlorine (HC1) of 0.5 to 10 vol % (in this embodiment, 3 vol %) at 950° C. for 30 minutes. If the concentration of HCl is higher than the above-mentioned concentration, asperities comparable to a film thickness are produced on the surfaces of the active layers 609, 610 and 611. Thus, such a high concentration is not preferable.

Although an example in which the HCl gas is used as a compound containing a halogen element has been described, one kind or plural kinds of gases selected from compounds containing halogen, such as typically HF, $NF_3$, HBr, $Cl_2$, $ClF_3$, $BCl_3$, $F_2$, and $Br_2$, may be used other than the HCl gas.

In this step, it is conceivable that nickel is removed in such a manner that nickel in the active layers 609, 610 and 611 is gettered by the action of chlorine and is transformed into volatile nickel chloride which is released into the air. By this step, the concentration of nickel in the active layers 609, 610 and 611 is lowered down to $5\times10^{17}$ atoms/cm$^3$ or less.

Incidentally, the value of $5\times10^{17}$ atoms/cm$^3$ is the lower limit of detection in the SIMS (Secondary Ion Mass Spectroscopy). As the result of analysis of TFTs experimentally produced by the present inventors, when the concentration is not higher than $1\times10^{18}$ atoms/cm$^3$ (preferably $5\times10^{17}$ atoms/cm$^3$ or less), an influence of nickel upon TFT characteristics can not be ascertained. However, it should be noted that the concentration of an impurity in the present specification is defined as a minimum value in measurement results of the SIMS analysis.

By the above heat treatment, a thermal oxidation reaction progresses at the interface between the gate insulating film 612 and the active layers 609, 610 and 611, so that the thickness of the gate insulating film 612 is increased by the thickness of a thermal oxidation film. When the thermal oxidation film is formed in this way, it is possible to obtain an interface of semiconductor/insulating film, which has very few interfacial levels. Moreover, there is also an effect to prevent inferior formation (edge thinning) of the thermal oxidation film at the end of the active layer.

The gettering process of the catalytic element may be carried out after the mask insulating film 603 is removed and before the active layer is patterned. And also, the gettering process of the catalytic element may be carried out after the active layer is patterned. Besides, any gettering processes may be combined.

Further, it is also effective that after the heat treatment in the above-mentioned halogen atmosphere is carried out, a heat treatment approximately at 950° C. for one hour is carried out in a nitrogen atmosphere to improve the film quality of the gate insulating film 612.

Incidentally, it is also ascertained by the SIMS analysis that the halogen element, which was used for the gettering process, having a concentration of $1\times10^{15}$ to $1\times10^{20}$ atoms/cm$^3$ remains in the active layers 609, 610 and 611.

Moreover, it is also ascertained by the SIMS analysis that at that time, the foregoing halogen element with a high concentration is distributed between the active layers 609, 610 and 611 and the thermal oxidation film formed by the heat treatment.

As the result of the SIMS analysis for other elements, it was ascertained that the concentration of any of C (carbon), N (nitrogen), O (oxygen), and S (sulfur) as typical impurities was less than $5\times10^{18}$ atoms/cm$^3$ (typically $1\times10^{18}$ atoms/cm$^3$ or less).

Figure 7A:
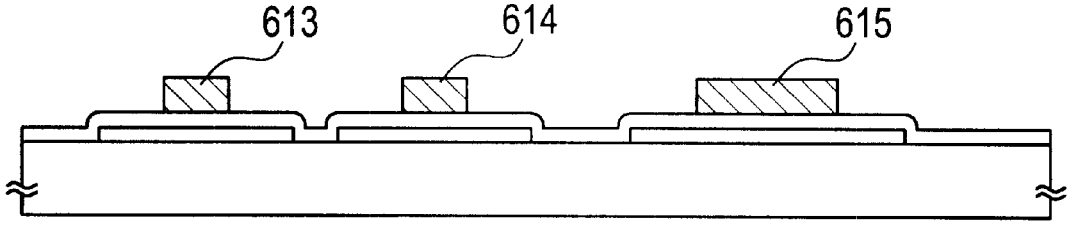
FIGS. 7A to 7D are views showing manufacturing steps of a semiconductor display device according to an embodiment of the present invention.

Next, a not-shown metal film containing aluminum as the main ingredient is formed, and originals 613, 614 and 615 of subsequent gate electrodes are formed by patterning. In this embodiment, an aluminum film containing scandium of 2 wt % is used (FIG. 7A).

Incidentally, a polycrystalline silicon film added with impurities may be used for the gate electrode, instead of the metal film containing aluminum as the main ingredient.

Figure 7B:
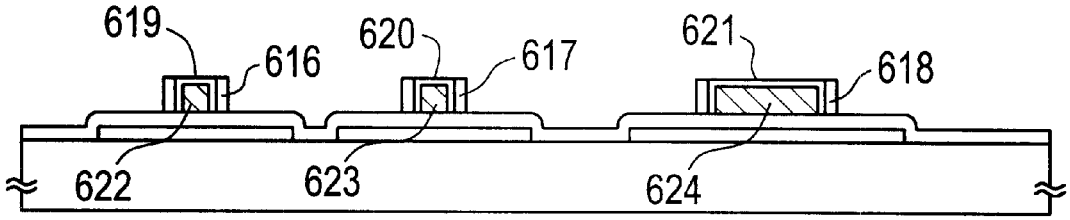
Figure 7C:
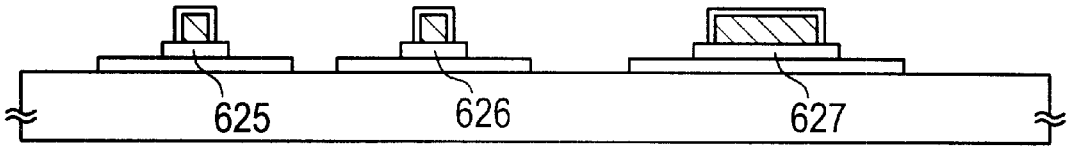

Next, by a technique disclosed in Japanese Patent Unexamined Publication No. Hei. 7-135318, porous anodic oxidation films 616, 617 and 618, nonporous anodic oxidation films 619, 620 and 621, and gate electrodes 622, 623 and 624 are formed (FIG. 7B).

After the state shown in FIG. 7B is obtained in this way, the gate insulating film 612 is next etched by using the gate electrodes 622, 623 and 624, and the porous anodic oxidation films 616, 617 and 618 as masks. Then the porous anodic oxidation films 616, 617 and 618 are removed to obtain the state shown in FIG. 7C. Incidentally, reference numerals 625, 626 and 627 in FIG. 7C denote gate insulating films after processing.

Next, an adding step of impurities giving one conductivity is carried out. As the impurity elements, P (phosphorus) or As (arsenic) may be used for an N type, and B (boron) or Ga (gallium) may be used for a P type.

In this embodiment, the addition of impurities is divided and is carried out two times. The first impurity addition (P (phosphorus) is used in this embodiment) is carried out at a high acceleration voltage of about 80 KeV to form an $n^-$ region. Adjustment is made so that the concentration of the P ion in the $n^-$ region becomes $1\times10^{18}$ to $1\times10^{19}$ atoms/cm$^3$.

Further, the second impurity addition is carried out at a low acceleration voltage of about 10 KeV to form an $n^+$ region. Since the acceleration voltage is low at this time, the gate insulating film functions as a mask. Adjustment is made so that the sheet resistance of the $n^+$ region becomes 500 Ω or less (preferably 300 Ω or less).

Through the above described steps, a source region 628, a drain region 629, a low concentration impurity region 630, and a channel formation region 631 of the N-type TFT constituting the CMOS circuit are formed. Moreover, a source region 632, a drain region 633, a low concentration impurity region 634, and a channel formation region 635 of the N-type TFT constituting the pixel TFT are defined (FIG. 7D).

Figure 7D:
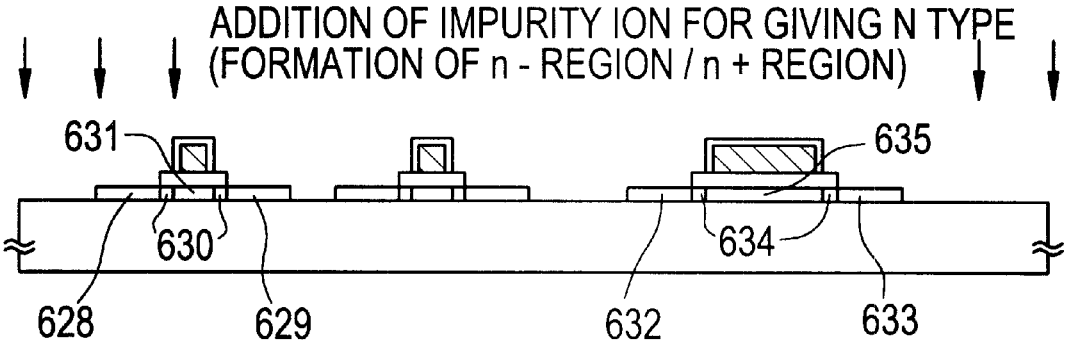

In the state shown in FIG. 7D, the active layer of the P-type TFT constituting the CMOS circuit also has the same structure as the active layer of the N-type TFT.

Figure 8A:
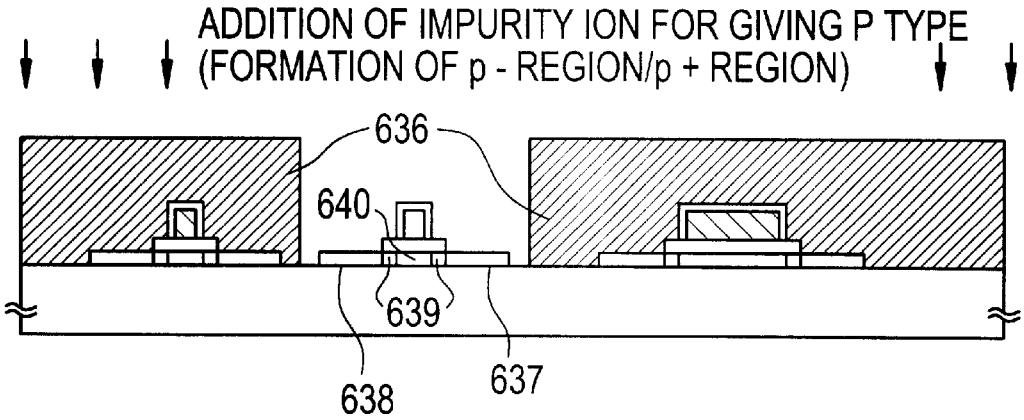
FIGS. 8A to 8C are views showing manufacturing steps of a semiconductor display device according to an embodiment of the present invention.

Next, as shown in FIG. 8A, a resist mask 636 covering the N type TFTs is provided, and an impurity ion for giving a P type (boron is used in this embodiment) is added.

Although this step is also divided and is carried out two times like the foregoing adding step of the impurity, since the N type must be inverted into the P type, the B (boron) ion with a concentration several times the foregoing addition concentration of the P ion is added.

In this way, a source region 637, a drain region 638, a low concentration impurity region 639, and a channel formation region 640 of the P-type TFT constituting the CMOS circuit are formed (FIG. 8A).

After the active layer is completed in the manner as described above, activation of the impurity ions is made by combination of furnace annealing, laser annealing, lamp annealing, and the like. At the same time, damages of the active layers caused in the adding steps are repaired.

Next, as an interlayer insulating film 641, a lamination film of a silicon oxide film and a silicon nitride film is formed. Next, after contact holes are formed in the interlayer insulating film, source electrodes 642, 643 and 644, and drain electrodes 645 and 646 are formed to obtain the state shown in FIG. 8B. An organic resin film may be used as the interlayer insulating film 641.

Figure 8B:
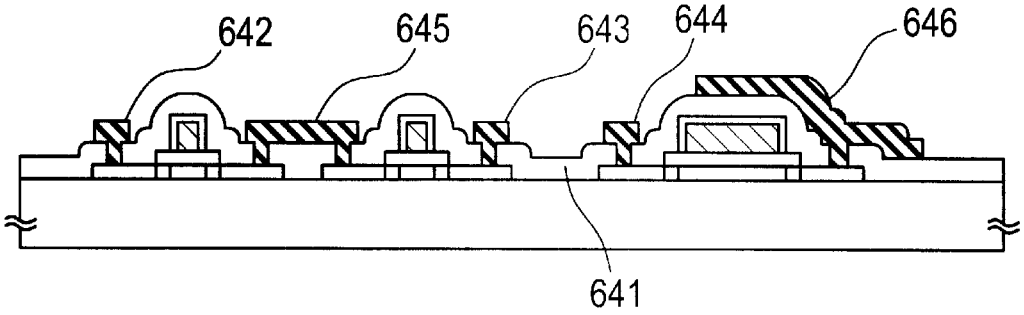

After the state shown in FIG. 8B is obtained, a second interlayer insulating film 647 made of an organic resin film and having a thickness of 0.5 to 3 μm is formed. Polyimide, acryl, polyimide amide, or the like may be used for the organic resin film. The merits of using the organic resin film are listed as follows: a film forming method is simple, a film thickness is easily made thick, parasitic capacitance can be reduced since its relative dielectric constant is low, and flatness is excellent.

Next, a black mask 648 made of a shading property and having a thickness of 100 nm is formed on the second interlayer insulating film 647. Although a titanium film is used as the black mask 648 in this embodiment, a resin film containing black pigments, or the like may be used.

Figure 8C:
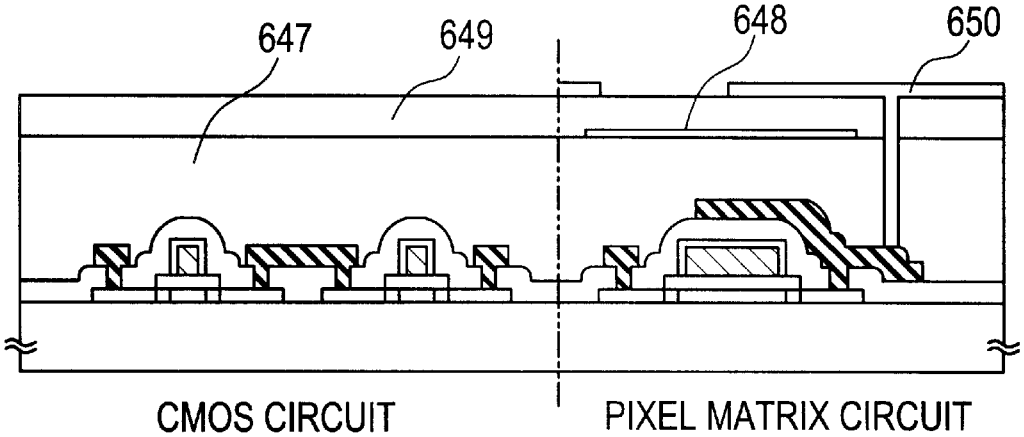

After the black mask 648 is formed, a third interlayer insulating film 649 made of one of a silicon oxide film, a silicon nitride film, and an organic resin film, or a lamination film thereof and having a thickness of 0.1 to 0.3 μm is formed. A contact hole is formed in the second interlayer insulating film 647 and the third interlayer insulating film 649, and a pixel electrode 650 with a thickness of 120 nm is formed. According to the structure of this embodiment, auxiliary capacitance is formed at a region where the black mask 648 overlaps with the pixel electrode (FIG. 8C). Since this embodiment relates to a transmission type liquid crystal display device, a transparent conductive film of ITO or the like is used as a conductive film forming the pixel electrode 650.

Next, the entire of the substrate is heated in a hydrogen atmosphere at a temperature of 350° C. for 1 to 2 hours to hydrogenate the entire of the device, so that the dangling bonds (unpaired bonds) in the film (especially in the active layer) are compensated. Through the above steps, it is possible to manufacture the CMOS circuit and the pixel matrix circuit on the same substrate.

Figure 9:
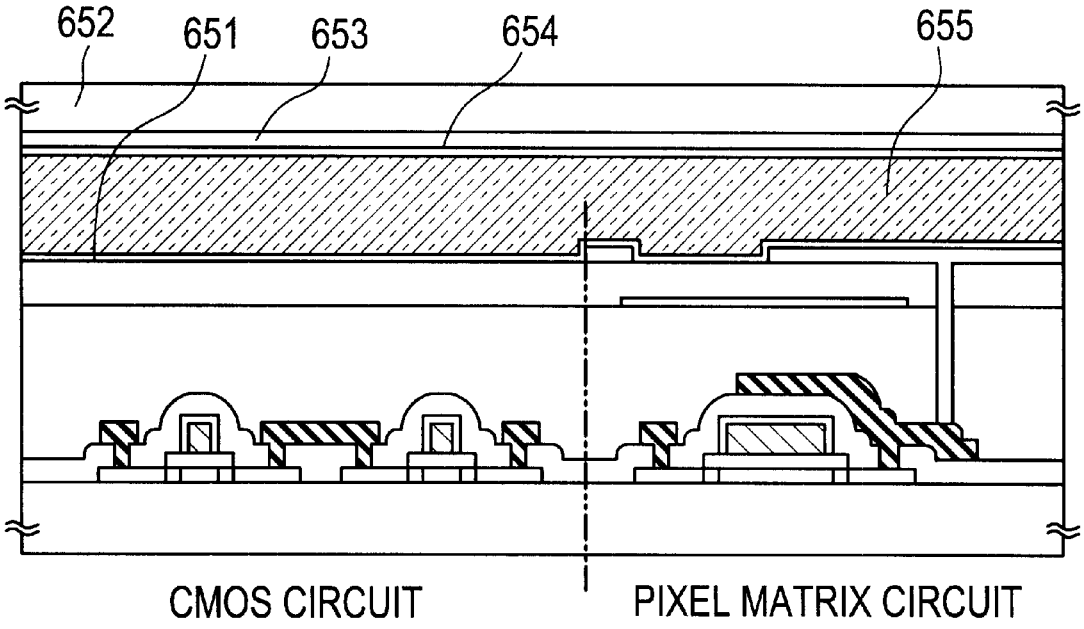
FIG. 9 is a sectional view of a semiconductor display device according to an embodiment of the present invention.

Next, as shown in FIG. 9, a step of manufacturing a liquid crystal panel on the basis of the active matrix substrate manufactured through the above steps will be described.

An oriented film 651 is formed on the active matrix substrate in the state of FIG. 8C. In this embodiment, polyimide is used for the oriented film 651. Next, an opposite substrate is prepared. The opposite substrate is constituted by a glass substrate 652, a transparent conductive film 653, and an oriented film 654.

In this embodiment, such a polyimide film that liquid crystal molecules are oriented parallel to the substrate is used as the oriented film. Incidentally, after the oriented film is formed, a rubbing process is carried out so that the liquid crystal molecules are parallel oriented with a fixed pretilt angle.

Although a color filter and the like are formed on the opposite substrate according to necessity, they are omitted here.

Next, the active matrix substrate and the opposite substrate obtained through the above steps are bonded to each other through a sealing material, a spacer and the like by known cell fabrication method (not shown). Thereafter, a liquid crystal material 655 is injected between both the substrates, and is completely sealed with a sealing agent (not shown). Thus, the transmission type liquid crystal panel as shown in FIG. 9 is completed.

In this embodiment, the liquid crystal panel is designed to make display with a TN (twisted nematic) mode. Thus, a pair of polarizing plates (not shown) are disposed so that the liquid crystal panel is held between the polarizing plates in cross Nicol (in the state in which polarizing axes of a pair of polarizing plates cross each other at right angles).

Thus, it is understood that in this embodiment, display is made in a normally white mode in which the liquid crystal panel becomes in a white display state when a voltage is not applied thereto.

Figure 10A:
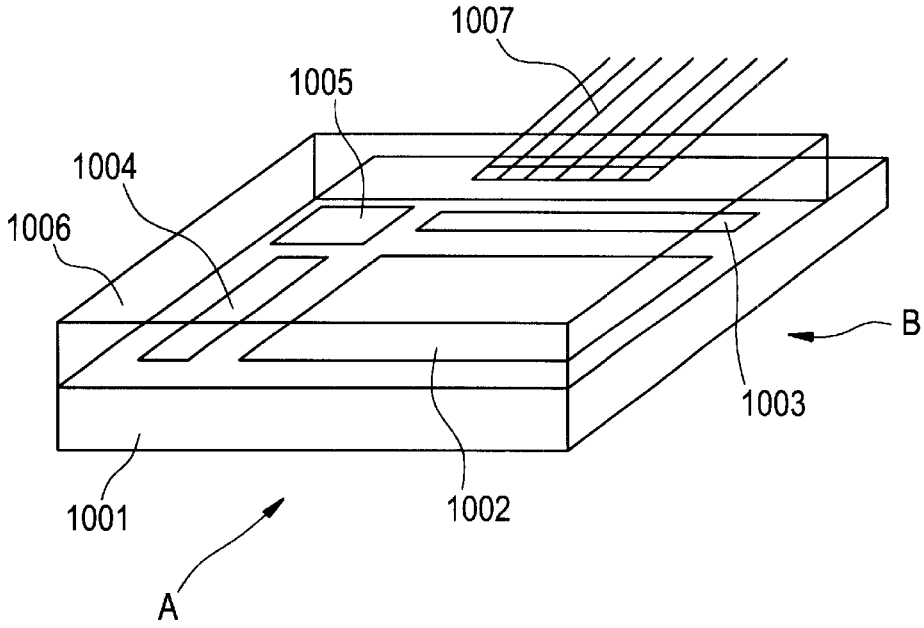
FIGS. 10A to 10C are a top view and side views of a semiconductor display device according to an embodiment of the present invention.
Figure 10B:
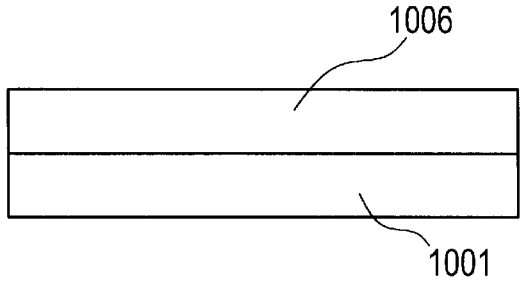
Figure 10C:
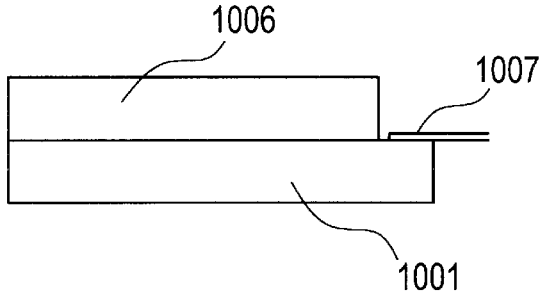

FIGS. 10A to 10C are views schematically showing the outer appearance of the manufactured liquid crystal panel. In FIGS. 10A to 10C, reference numeral 1001 denotes a quartz substrate, 1002 denotes a pixel matrix circuit, 1003 denotes a source signal line side driver circuit, 1004 denotes a gate signal line side driver circuit, and 1005 denotes other logic circuit. Reference numeral 1006 denotes an opposite substrate, and 1007 denotes an FPC (Flexible Print Circuit) terminal. FIG. 10B is a view showing the liquid crystal panel of this embodiment seen from arrow A in FIG. 10A, and FIG. 10C is a view showing the liquid crystal panel seen from arrow B in FIG. 10A.

Although the logic circuit 1005 includes all logical circuits constituted by TFTs in a wide sense, in order to distinguish the logic circuit from such a circuit as is conventionally called a pixel matrix circuit or a driving circuit, the logic circuit in the present specification indicates signal processing circuits (LCD controller, memory, pulse generator, and the like) other than such a circuit.

FIGS. 10B and 10C show that in the liquid crystal panel of this embodiment, the active matrix substrate is exposed only at an end surface where an FPC is attached. It is understood that other three end surfaces are flush.

Figure 19:
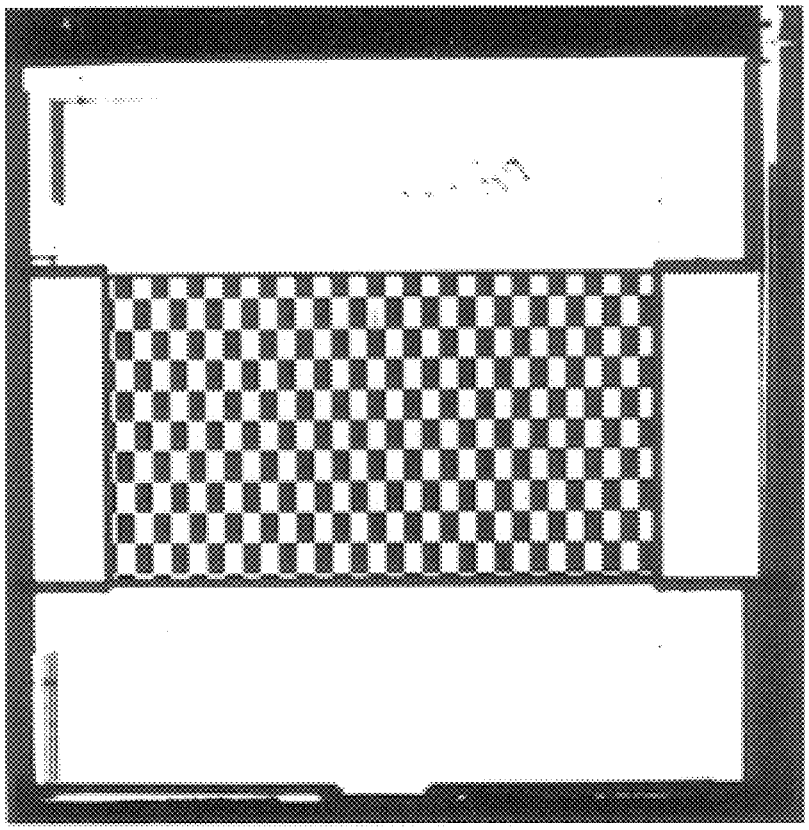
FIG. 19 is a photograph of a semiconductor display device according to an embodiment of the present invention.

FIG. 19 is a photograph showing the active matrix type liquid crystal display device of this embodiment. From FIG. 19, it is understood that an excellent check pattern is displayed.

Here, a semiconductor thin film manufactured according to the manufacturing method of this embodiment will be described. According to the manufacturing method of this embodiment, it is possible to crystalize an amorphous silicon film and to obtain a crystal silicon film called continuous grain boundary crystal silicon (so-called Continuous Grain Silicon: CGS).

The lateral growth region of the semiconductor thin film obtained through the manufacturing method of this embodiment has a unique crystal structure made of a collective of rod-like or flattened rod-like crystals. The features thereof will be described below.

[Findings as to crystal structure of a lateral growth region]

The lateral growth region of this embodiment has microscopically a crystal structure in which a plurality of rod-like (or flattened rod-like) crystals are arranged in almost parallel to each other and with regularity to a specific direction. This can be easily ascertained by observation with a TEM (Transmission Electron Microscope).

Figure 20:
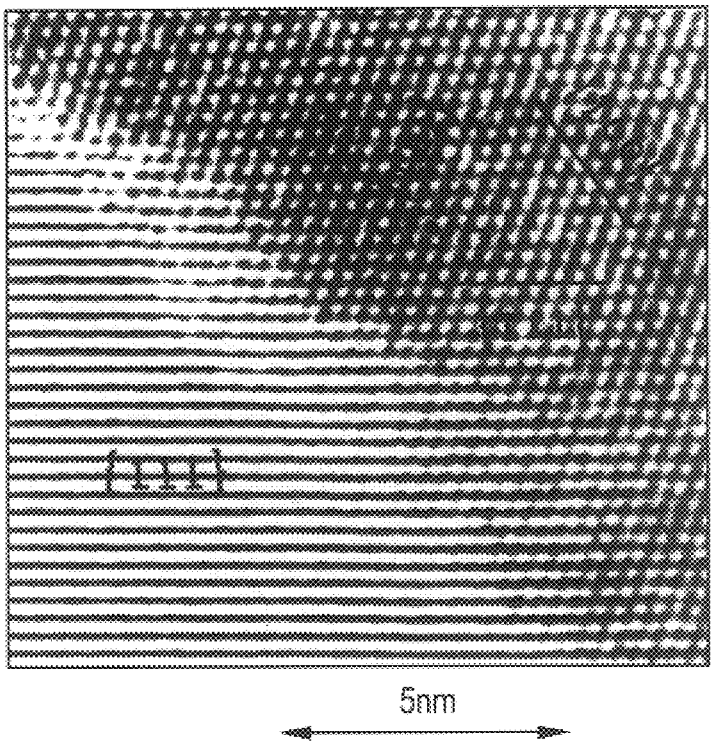
FIG. 20 is a TEM photograph of CGS.

The present inventors observed the crystal grain boundaries of the semiconductor thin film obtained by the manufacturing method of this embodiment in detail by using an HR-TEM (High Resolution Transmission Electron Microscope) (FIG. 20). In the present specification, the crystal grain boundary is defined as a grain boundary formed at an interface where different rod-like crystals are in contact with each other, unless specified otherwise. Thus, the crystal grain boundary is regarded as different from, for example, a macroscopic grain boundary formed by collision of separate lateral growth regions.

The foregoing HR-TEM (High Resolution Transmission Electron Microscope) is a method in which a sample is vertically irradiated with an electron beam, and the arrangement of atoms and molecules is estimated by using interference of transmitted electrons or elastically scattered electrons. By using this method, it is possible to observe the state of arrangement of crystal lattices as lattice stripes. Thus, by observing the crystal grain boundary, it is possible to infer the bonding state of atoms in the crystal grain boundary.

In the TEM photograph (FIG. 20) obtained by the present inventors, the state where two different crystal grains (rod-like crystal grains) are in contact with each other at the crystal grain boundary is clearly observed. At this time, it is ascertained by electron beam diffraction that the two crystal grains are almost in {110} orientation although some deviations are included in crystal axes.

In the observation of lattice stripes by the TEM photograph as described above, lattice stripes corresponding to a {111} plane are observed in a {110} plane. Incidentally, the lattice stripe corresponding to the {111} plane indicates such a lattice stripe that when a crystal grain is cut along the lattice stripe, the {111} plane appears in the section. According to a simplified manner, it is possible to ascertain by the distance between the lattice stripes to what plane the lattice stripe corresponds.

At this time, the present inventors observed in detail the TEM photograph of the semiconductor thin film obtained through the manufacturing method of this embodiment, and as a result, very interesting findings were obtained. In both of the two different crystal grains seen in the photograph, lattice stripes corresponding to the {111} plane were seen. And it was observed that the lattice stripes were obviously parallel to each other.

Further, irrespective of the existence of the crystal grain boundary, the lattice stripes of the two different crystal grains were connected to each other so as to cross the crystal grain boundary. That is, it was ascertained that almost all lattice stripes observed to cross the crystal grain boundary were linearly continuous with each other in spite of the fact that they were lattice stripes of different crystal grains. This is the case with any crystal grain boundary.

Such a crystal structure (precisely the structure of crystal grain boundary) indicates that two different crystal grains are in contact with each other with excellent conformity at the crystal grain boundary. That is, crystal lattices are continuously connected to each other at the crystal grain boundary, so that such a structure is formed that it is very hard to produce trap levels caused by crystal defects or the like. In other words, it can be said that the crystal lattices have continuity at the crystal grain boundary.

Figure 21:
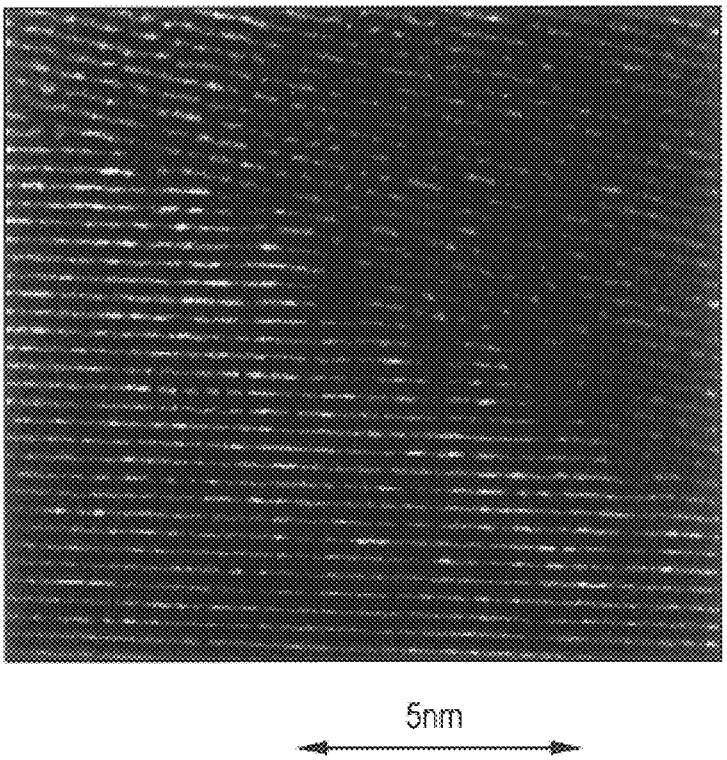
FIG. 21 is a TEM photograph of high temperature polysilicon.

In FIG. 21, for reference, analysis by the electron beam diffraction and HR-TEM observation was carried out by the present inventors for a conventional polycrystalline silicon film (so-called high temperature polysilicon film) as well. As a result, it was found that lattice stripes were random in the two different crystal grains and there hardly existed connection continuous at the crystal grain boundary with excellent conformity. That is, it was found that there were many portions where the lattice stripes were discontinuous at the crystal grain boundary, and there were many crystal defects.

The present inventors refer to the bonding state of atoms in the case where the lattice stripes correspond to each other with good conformity, like the semiconductor thin film used in the liquid crystal panel of the semiconductor device of the present invention, as conformity bonding, and refers to a chemical bond at that time as a conformity bond. On the contrary, the present inventors refer to the bonding state of atoms in the case where the lattice stripes do not correspond to each other with good conformity often seen in a conventional polycrystalline silicon film as unconformity bonding, and refers to a chemical bond at that time as an unconformity bond (or an unpaired bond).

Since the semiconductor thin film used in the present invention is extremely excellent in conformity at the crystal grain, the foregoing unconformity bonds are very few. As the result of study for arbitrary plural crystal grain boundaries conducted by the present inventors, the existing ratio of the unconformity bonds to the total bonds was 10% or less (preferably 5% or less, more preferably 3% or less). That is, 90% or more of the total bonds (preferably 95% or more, more preferably 97% or more) are constituted by the conformity bonds.

Figure 22A:
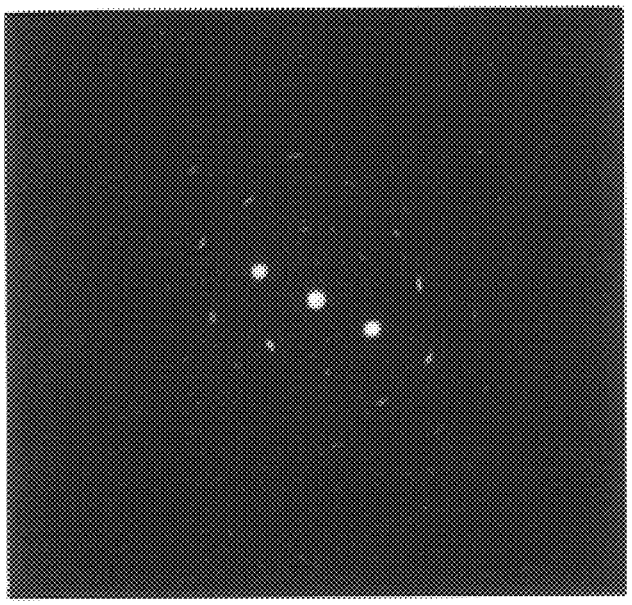
FIGS. 22A and 22B are photographs showing electron beam diffraction patterns of CGS and high temperature polysilicon.
Figure 22B:
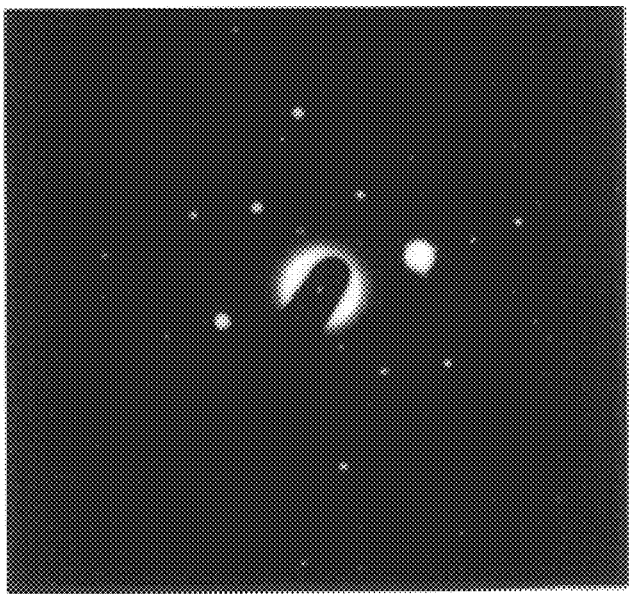

FIG. 22A shows the result of observation by electron beam diffraction for a lateral growth region formed in accordance with the manufacturing steps of the foregoing embodiment. FIG. 22B shows an electron beam diffraction pattern of a conventional polysilicon film (what is called a high temperature polysilicon film) observed for comparison.

In the electron beam diffraction patterns shown in FIGS. 22A and 22B, the diameter of an irradiation area of an electron beam is 4.25 $\mu$m, and the information for a sufficiently macro region is collected. The photographs here show typical diffraction patterns in the results of investigation for arbitrary plural portions.

In the case of FIG. 22A, since diffraction spots (diffraction speckles) corresponding to the <110> incidence appear clearly, it can be ascertained that almost all crystal grains are oriented in {110} in the irradiation area of the electron beam. On the other hand, in the case of the conventional high temperature polysilicon film shown in FIG. 22B, definite regularity was not seen in the diffraction spots, and it was found that crystal grains with plain orientation other than the {110} plane were irregularly mixed.

Like this, the feature of the semiconductor thin film used in the present invention is that although the semiconductor thin film includes crystal grain boundaries, the semiconductor thin film shows the electron beam diffraction pattern having regularity peculiar to the {110} orientation. When the electron beam diffraction pattern is compared with a conventional one, the difference from the conventional semiconductor thin film is clear.

As described above, the semiconductor thin film manufactured by the manufacturing steps of the foregoing embodiment was a semiconductor thin film having crystal structure (precisely structure of a crystal grain boundary) quite different from a conventional semiconductor thin film. The present inventors have explained the results of analysis as to the semiconductor thin film used in the present invention also in Japanese Patent Application Nos. Hei. 9-55633, Hei. 9-165216 and Hei. 9-212428.

Moreover, since 90% or more of the crystal grains of the foregoing semiconductor thin film used in the present invention are constituted by the conformity bonds, they have hardly the function as a barrier for blocking the movement of carriers. That is, it can be said that there are substantially no crystal grain boundaries in the semiconductor thin film used in the present invention.

Although crystal grain boundaries function as barriers for blocking the movement of carriers in a conventional semiconductor thin film, since such crystal grain boundaries do not substantially exist in the semiconductor thin film used in the present invention, high carrier mobility can be realized. Thus, the electrical characteristics of a TFT manufactured by using the semiconductor thin film used in the present invention show extremely excellent values. This will be described below.

[Findings as to electrical characteristics of a TFT]

Since the semiconductor thin film used in the present invention can be regarded substantially as a single crystal (since crystal grain boundaries do not exist substantially), a TFT using the semiconductor thin film as an active layer shows electrical characteristics comparable to a MOSFET using single crystal silicon. Data as shown below are obtained from TFTs experimentally formed by the present inventors.

(1) The subthreshold coefficient as an index showing switching performance (promptness in switching of on/off operation) of a TFT is as small as 60 to 100 mV/decade (typically 60 to 85 mV/decade) for both an N-channel TFT and a P-channel TFT.

(2) The field effect mobility ($\mu_{FE}$) as an index showing an operation speed of a TFT is as large as 200 to 650 $cm^2/Vs$ (typically 250 to 300 $cm^2/Vs$) for an N-channel TFT, and 100 to 300 $cm^2/Vs$ (typically 150 to 200 $cm^2/Vs$) for a P-channel TFT.

(3) The threshold voltage ($V_{th}$) as an index indicating a driving voltage of a TFT is as small as −0.5 to 1.5 V for an N-channel TFT and −1.5 to 0.5 V for a P-channel TFT.

As described above, it is ascertained that the TFT obtained in the present invention can realize extremely superior switching characteristics and high speed operation characteristics.

Incidentally, in the formation of the CGS, the foregoing annealing step at a temperature (700 to 1100° C.) above the crystallizing temperature plays an important role with respect to lowering of defects in crystal grains. This will be described below.

Figure 23A:
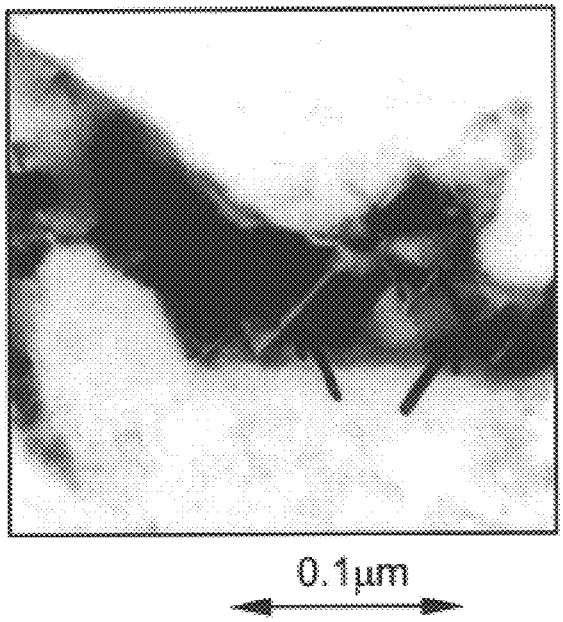
FIGS. 23A and 23B are TEM photographs of CGS and high temperature polysilicon

FIG. 23A is a TEM photograph of a crystalline silicon film at the point of time when steps up to the foregoing crystallizing step have been ended, which is magnified 250 thousands times. Zigzag defects as indicated by arrows are ascertained in the crystal grain (black portion and white portion appear due to the difference in contrast).

Although such defects are mainly lamination defects in which the order of lamination of atoms on a silicon crystal lattice plane is discrepant, there is also a case of dislocation or the like. It appears that FIG. 23A shows the lamination defects having a defect plane parallel to the {111} plane. This can be ascertained from the fact that the zigzag defects are bent at about 70°.

Figure 23B:
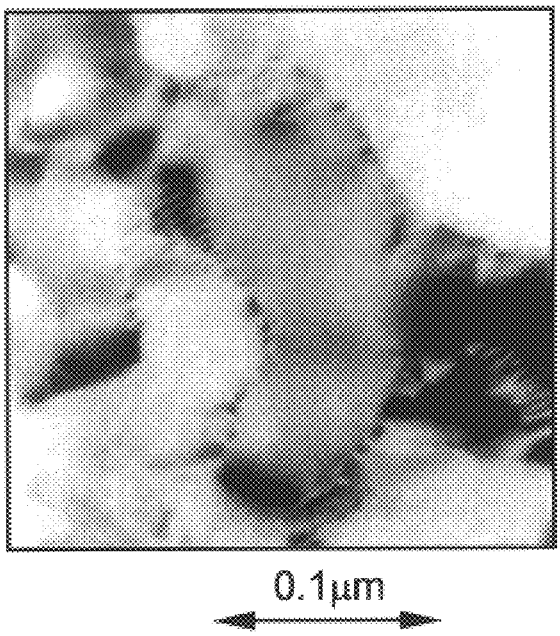

On the other hand, as shown in FIG. 23B, in the crystalline silicon film used in the present invention, which is magnified at the same magnification, it is ascertained that there are hardly seen defects caused by lamination defects, in crystal grains dislocations and the like, and the crystallinity is very high. This tendency can be seen in the entire of the film surface, and although it is difficult to reduce the number of defects to zero in the present circumstances, it is possible to lower the number to substantially zero.

That is, in the crystalline silicon film used in the liquid crystal panel of the semiconductor device of the present invention, defects in the crystal grain are reduced to the degree that the defects can be almost neglected, and the crystal grain boundary can not become a barrier against movement of carriers due to the high continuity, so that the film can be regarded as a single crystal or substantially single crystal.

Like this, in the crystalline silicon films shown in the photographs of FIGS. 23A and 23B, although the crystalline grain boundaries have almost equal continuity, there is a large difference in the number of defects in the crystal grain. The reason why the crystalline silicon film shown in FIG. 23B shows electrical characteristics much higher than the crystalline silicon film shown in FIG. 23A is mainly the difference in the number of defects.

From the above, it is understood that the gettering process of a catalytic element is an indispensable step in the formation of the CGS. The present inventors consider the following model for a phenomenon occurring in this step.

First, in the state shown in FIG. 23A, the catalytic element (typically nickel) is segregated at the defects (mainly lamination defects) in the crystal grain. That is, it is conceivable that there are many bonds having form such as Si—Ni—Si.

However, when Ni existing in the defects is removed by carrying out the gettering process of the catalytic element, the bond of Si—Ni is cut. Thus, the remaining bond of silicon immediately forms Si—Si bond and becomes stable. In this way, the defects disappear.

Of course, although it is known that the defects in a crystalline silicon film disappear by thermal annealing at a high temperature, it can be presumed that since bonds with nickel are cut and many unpaired bonds are generated, so that recombination of silicon is smoothly carried out.

The present inventors consider also a model in which the crystalline silicon film is bonded to its under layer by a heat treatment at a temperature (700 to 1100° C.) above the crystallizing temperature and adhesiveness is increased, so that the defects disappear.

The thus obtained crystalline silicon film (FIG. 23B) has the feature that the number of defects in the crystal grain is extremely smaller than the crystalline silicon film (FIG. 23A) in which merely crystallization is carried out. The difference in the number of defects appears as the difference in spin density by an electron spin resonance analysis (Electron Spin Resonance: ESR). In the present circumstances, the spin density of the crystalline silicon film used in the present invention is at most $1\times10^{18}$ spins/cm$^3$ (typically $5\times10^{17}$ spins/cm$^3$ or less).

The crystalline silicon film having the above described crystal structure and the features, which is used in the present invention, is called a continuous grain boundary crystal silicon (Continuous Grain Silicon: CGS).

Embodiment 3

In this embodiment, a semiconductor display device including a driving circuit described in the embodiment 1 is manufactured with a reverse stagger type.

Figure 11:
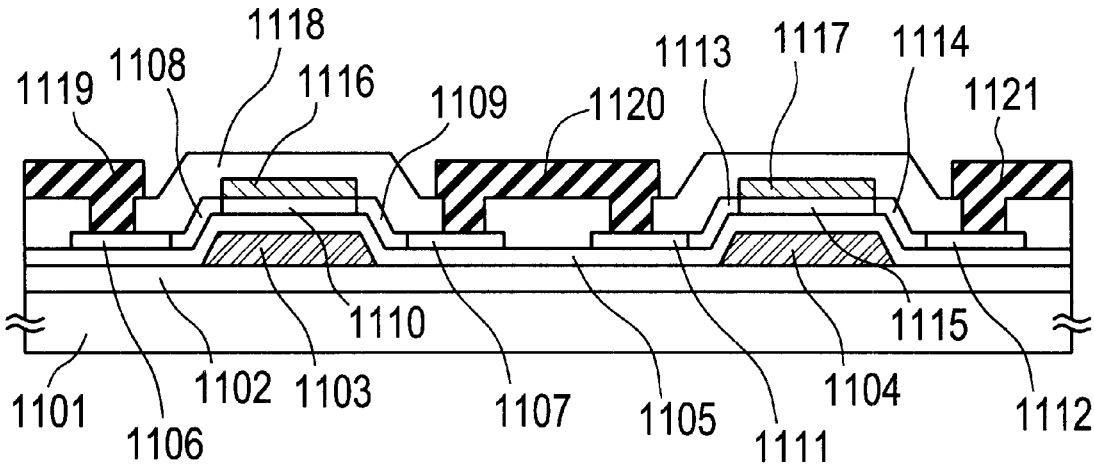
FIG. 11 is a sectional view of an active matrix substrate of a semiconductor display device according to an embodiment of the present invention.

Reference will be made to FIG. 11. FIG. 11 is a sectional view of an active matrix substrate of a semiconductor display device of this embodiment. In the drawing, a CMOS circuit is shown as a typical circuit of a driving circuit of a semiconductor display device. A pixel matrix circuit constituted by pixel TFTs and other peripheral circuit are also formed at the same time.

Reference numeral 1101 denotes a substrate, 1102 denotes an under insulating film, 1103 and 1104 denote gate electrodes, 1105 denotes a gate insulating film, 1106 and 1107 denote source/drain regions of an N type TFT, 1108 and 1109 denote low concentration impurity regions, 1110 denotes a channel formation region, 1111 and 1112 denote source/drain regions of a P type TFT, 1113 and 1114 denote low concentration impurity regions, 1115 denotes a channel formation region, 1116 and 1117 denote channel stoppers, 1118 denotes an interlayer insulating film, and 1119, 1120, and 1121 denote source/drain electrodes. The channel stoppers 1116 and 1117 function as doping masks at the formation of the channel formation regions of the N type and P type TFTs.

The semiconductor active layer of this embodiment can be made polycrystalline by the method of the embodiment 2.

Moreover, the semiconductor active layer of this embodiment can be made polycrystalline by using a laser annealing technique.

Other structures may follow the embodiment 2.

Embodiment 4

In this embodiment, a semiconductor display device including a driving circuit described in the embodiment 1 is manufactured with a reverse stagger type different from that in the embodiment 3.

Figure 12:
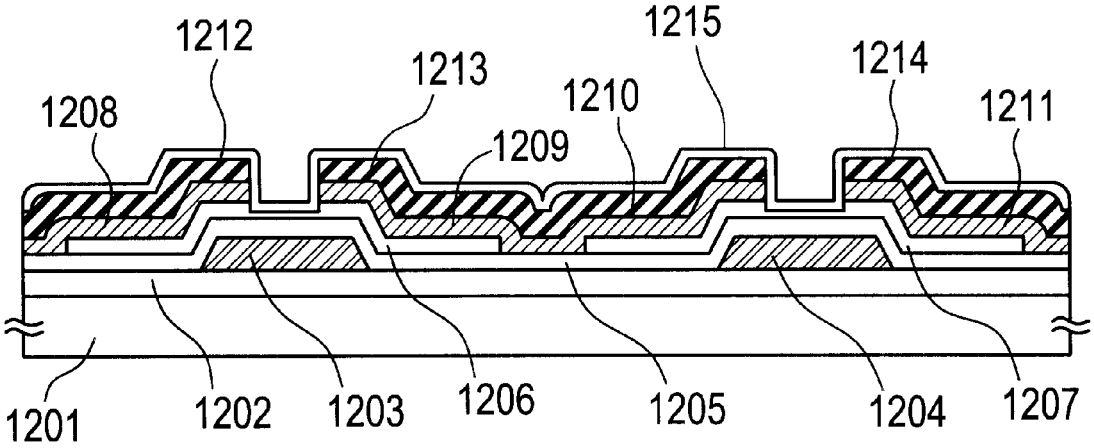
FIG. 12 is a sectional view of an active matrix substrate of a semiconductor display device according to an embodiment of the present invention.

Reference will be made to FIG. 12. Reference numeral 1201 denotes a substrate, 1202 denotes an under insulating film, 1203 and 1204 denote gate electrodes, 1205 denotes a gate insulating film, 1206 and 1207 denote semiconductor active layers, 1208 and 1209 denote $n^+$ layers, 1210 and 1211 denote $p^+$ layers, 1212, 1213, and 1214 denote source/drain electrodes, and 1215 denotes a channel protective film.

The semiconductor active layer of this embodiment can be made polycrystalline by the method of the embodiment 2.

Moreover, the semiconductor active layer of this embodiment can be made polycrystalline by using a laser annealing technique.

Other structures may follow the embodiment 2.

Embodiment 5

In this embodiment, an example of a specific circuit structure of a switch circuit will be described. In this embodiment, a block diagram of the main portion of an active matrix type semiconductor display device will be shown. A shift register circuit, a latch circuit and the like may be referred to the embodiment 1. Also in this embodiment, it is possible to construct an active matrix type liquid crystal display device using a liquid crystal as a display medium.

Figure 15:
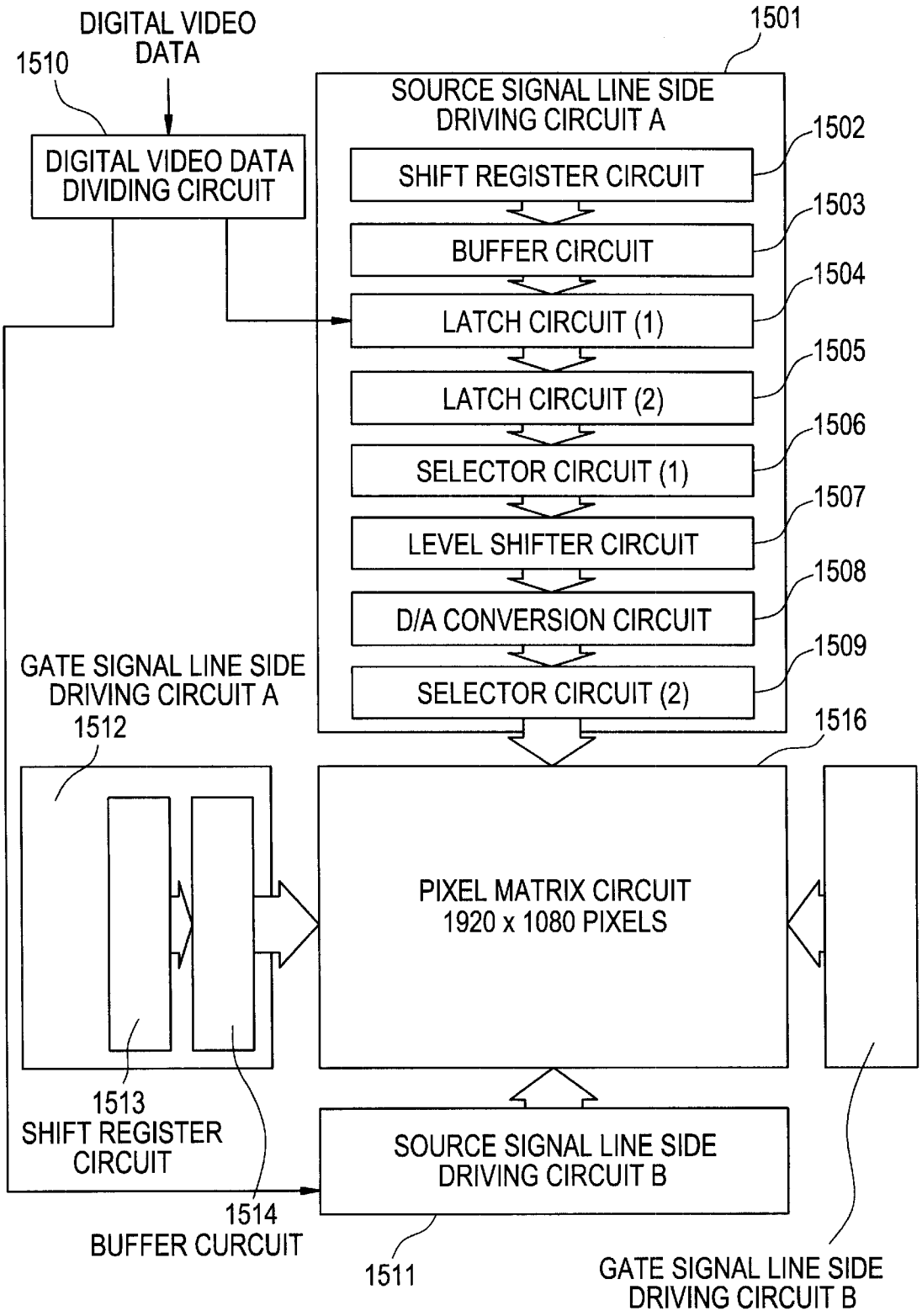
FIG. 15 is a block diagram of a semiconductor display device according to an embodiment of the present invention.

Reference will be made to FIG. 15. FIG. 15 is a block diagram of the main portion of the active matrix type semiconductor display device of this embodiment. The points different from the embodiment 1 are that source signal line side driving circuits are used up and down so that a pixel matrix circuit is put between the driving circuits, gate signal line side driving circuits are used right and left so that the pixel matrix circuit is put between the driving circuits, a level shifter circuit is used for the source signal line side driving circuit, a digital video data dividing circuit is provided, and so on. With respect to a D/A conversion circuit, although such a D/A conversion circuit as in the embodiment 1 is used, it is also possible to design such that digital video data are divided into an upper bit and a lower bit, and the digital video data are converted into analog picture signals by first and second D/A conversion circuits. It is appropriate that the level shifter circuit is used as the need arises, and the circuit is not always required to be used.

The active matrix type liquid crystal display device of this embodiment includes a source signal line side driving circuit A 1501, a source signal line side driving circuit B 1511, a gate signal line side driving circuit A 1512, a gate signal line side driving circuit B 1515, a pixel matrix circuit 1516, and a digital video data dividing circuit 1510.

The source signal line side driving circuit A 1501 includes a shift register circuit 1502, a buffer circuit 1502, a latch circuit (1) 1504, a latch circuit (2) 1505, a selector (switch) circuit (1) 1506, a level shifter circuit 1507, a D/A conversion circuit 1508, and a selector (switch) circuit (2) 1509. The source signal line side driving circuit A 1501 supplies picture signals (gradation voltage signals) to odd source signal lines. In this embodiment, a circuit equivalent to the switch circuit explained in the embodiment 1 will be referred to as a selector circuit.

The operation of the source signal line side driving circuit A 1501 will be described. A start pulse and a clock pulse are inputted into the shift register circuit 1502. The shift register circuit 1502 sequentially supplies timing signals to the buffer circuit 1503 on the basis of the foregoing start pulse and the clock signal.

The timing signal from the shift register circuit 1502 is buffered by the buffer circuit 1503. Since many circuits or components are connected between the shift register circuit 1502 and source signal lines connected to the pixel matrix circuit 1516, load capacitance is large. This buffer circuit 1503 is provided to prevent "dulling" of the timing signal caused by the large load capacitance.

The timing signal buffered by the buffer circuit 1503 is supplied to the latch circuit (1) 1504. The latch circuit (1) 1504 includes 960 latch circuits each processing 2-bit data. When the timing signal is inputted, the latch circuit (1) 1504 sequentially receives digital signals supplied from the digital video data dividing circuit and holds them.

A time in which writing of the digital signals into all the latch circuits of the latch circuit (1) 1504 is generally ended, is referred to as one line period (horizontal scanning period). That is, one line period is a time interval between the start point of writing of digital video data from the digital video data dividing circuit into the leftmost latch circuit in the latch circuit (1) 1504 and the end point of writing of the digital video data into the rightmost latch circuit.

After the writing of the digital video data into the latch circuit (1) 1504 is ended, the digital video data written in the latch circuit (1) 1504 are transmitted to and written in the latch circuit (2) 1505 all at once when a latch pulse is flown to the latch pulse line, connected to the latch circuit (2) 1505, synchronously with the operation timing of the shift register circuit 1502.

Into the latch circuit (1) 1504 which has finished transmitting the digital video data to the latch circuit (2) 1505, writing of the digital video signal supplied from the digital video data dividing circuit is again sequentially carried out by the timing signal from the shift register circuit 1502. Such operations of the latch circuit (1) 1504 and the latch circuit (2) 1505 are the same as the embodiment 1.

In the second one line period, the digital video data transmitted to the latch circuit (2) 1505 synchronously with the start of the second one line period are sequentially selected by the selector circuit (1) 1506. The structure and operation of the selector circuit of this embodiment will be described later.

The 2-bit digital video data from the latch circuit, which are selected by the selector circuit (1) 1506, are supplied to the level shifter circuit 1507. The voltage level of the digital video data is raised by the level shifter circuit 1507, and the digital video data are supplied to the D/A conversion circuit 1508. The D/A conversion circuit 1508 converts the 2-bit digital video data into analog signals (gradation voltages), and the analog signals are sequentially supplied to the source signal lines selected by the selector circuit (2) 1509. The analog signal supplied to the source signal line is supplied to the source region of the pixel TFT of the pixel matrix circuit 1516.

In the gate signal line side driving circuit A 1512, timing signals from the shift register circuit 1513 are supplied to the buffer circuit 1514, and are supplied to the corresponding gate signal lines (scanning lines). Gate electrodes of the pixel TFTs for one line are connected to the gate signal line, and since all the pixel TFTs for one line must be turned ON at the same time, the buffer circuit 1514 having large current capacity is used.

Like this, switching of the corresponding TFTs is carried out by scanning signals from the gate signal line side shift register, the analog signals (gradation voltages) from the source signal line side driving circuit are supplied to the pixel TFTs, and liquid crystal molecules are driven.

Reference numeral 1511 denotes a source signal line side driving circuit B, and its structure is the same as the source signal line side driving circuit A 1501. The source signal line side driving circuit B 1511 supplies picture signals to the even source signal lines.

Reference numeral 1515 denotes a gate signal line side driving circuit B, which has the same structure as the gate signal line side driving circuit A 1512. In this embodiment, the gate signal line side driving circuits are provided at both ends of the pixel matrix circuit 1516 in this way, and both the gate signal line side driving circuit are operated, so that even if one of them does not work, poor display is not caused.

Reference numeral 1510 denotes the digital video data dividing circuit. The digital video data dividing circuit is a circuit for dropping the frequency of digital video data inputted from the outside by 1/m. By dividing the digital video data, the frequency of the signal required for the operation of the driving circuit can also be dropped by 1/m.

Japanese Patent Application No. Hei. 9-356238 by the same assignee as the present application discloses that a digital video data dividing circuit is integrally formed on the same substrate as a pixel matrix circuit or other driving circuits. The foregoing patent application discloses the operation of the digital video data dividing circuit in detail, and the application may be referred to for understanding of the digital video data dividing circuit of this embodiment.

The pixel matrix circuit 116 has such a structure that 1920×1080 pixel TFTs are arranged in matrix.

The foregoing operation is repeated, the number of repetitions being equal to the number of scanning lines, so that one screen (one frame) is formed. In the active matrix type liquid crystal display device of this embodiment, pictures of 60 frames are rewritten in one second.

Here, the structures and operations of the selector circuit (1) 1506 and the selector circuit (2) 1509 will be described. The basic concept of the selector circuit is the same as the switch circuit described in the embodiment 1. In this embodiment, one selector circuit (1) 1506 and one selector circuit (2) 1509 are used for every four source signal lines. Thus, 240 selector circuits (1) 1506 and 240 selector circuits (2) 1509 are used in the source signal line side driving circuit (A) 1501, and 240 selector circuits (1) and 240 selector circuits (2) are used in the source signal line side driving circuit (B) 1511.

Figure 16:
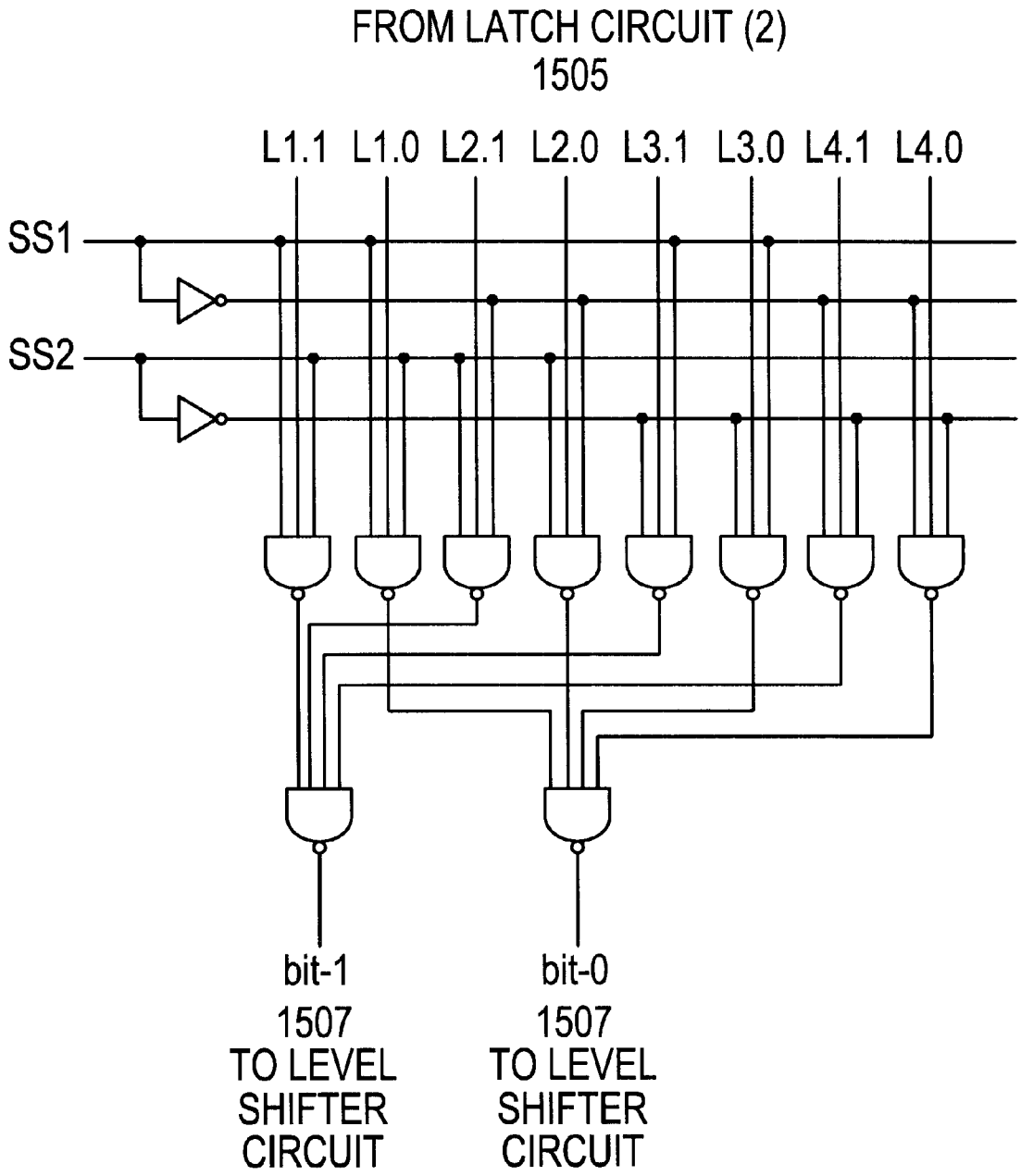
FIG. 16 is a circuit structural view of a selector circuit (switch circuit) according to an embodiment of the present invention.

Reference will be made to FIG. 16. For convenience of explanation, FIG. 16 shows only the leftmost selector circuit (1) of the source signal line side driving circuit (A). The actual source signal line side driving circuit is provided with 240 selector circuits.

As shown in FIG. 16, one of the selector circuits (1) of this embodiment includes eight 3-input NAND circuits, two 4-input NAND circuits, and two inverters. Signals from the latch circuit (2) 1505 are inputted to the selector circuit (1) 1506 of this embodiment, and in the signal lines L0.0, L0.1, L1.0, L1.1 . . . L1919.0, L1919.1 from the latch circuit (2) 1505, the signal lines L0.0, L0.1, L1.0, L1.1, L2.0, L2.1, L3.0, L3.1 are connected to the selector circuit (1) 1506 shown in FIG. 16. The notation La.b means that a b-th bit signal of the digital video data is supplied to the a-th source signal line from the left. Timing signals are inputted from the signal lines SS1 and SS2 into the selector circuit (1) 1506. Signals from the selector circuit (1) 1506 are inputted into the level shifter circuit 1507, and then, are inputted into the D/A conversion circuit 1508.

Figure 17:
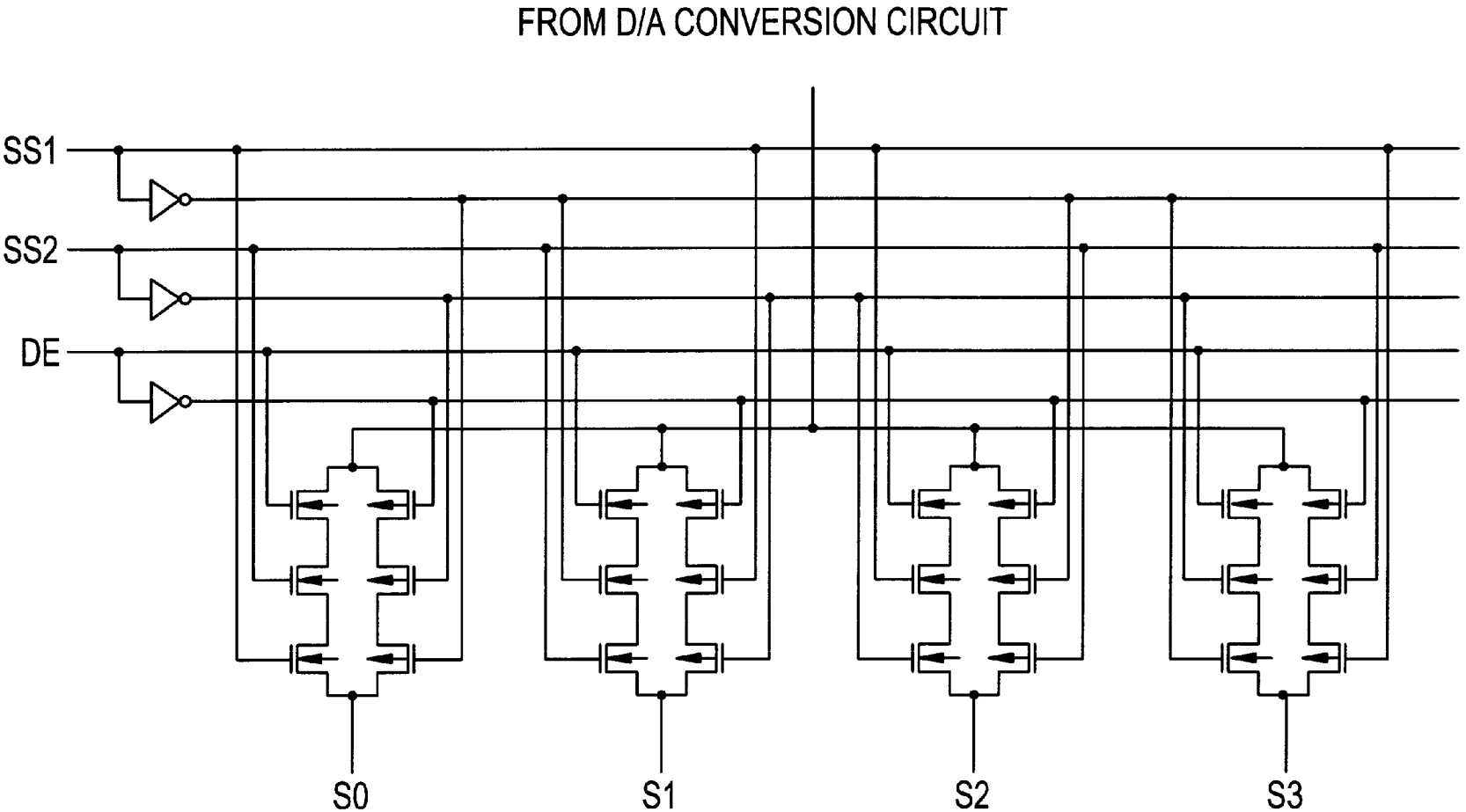
FIG. 17 is a circuit structural view of a selector circuit (switch circuit) according to an embodiment of the present invention.

Here, reference will be made to FIG. 17. FIG. 17 shows the selector circuit (2) 1509. For convenience of explanation, FIG. 17 shows the leftmost selector circuit (2) 1509. The actual source signal line side driving circuit is provided with 240 selector circuits.

As shown in FIG. 17, the selector circuit (2) 1509 of this embodiment includes four analog switches having three P-channel TFTs and three N-channel TFTs, and three inverters. Analog picture signals converted into the analog signals by the D/A conversion circuit 1508 are inputted into the selector circuit (2) 1509.

Figure 18:
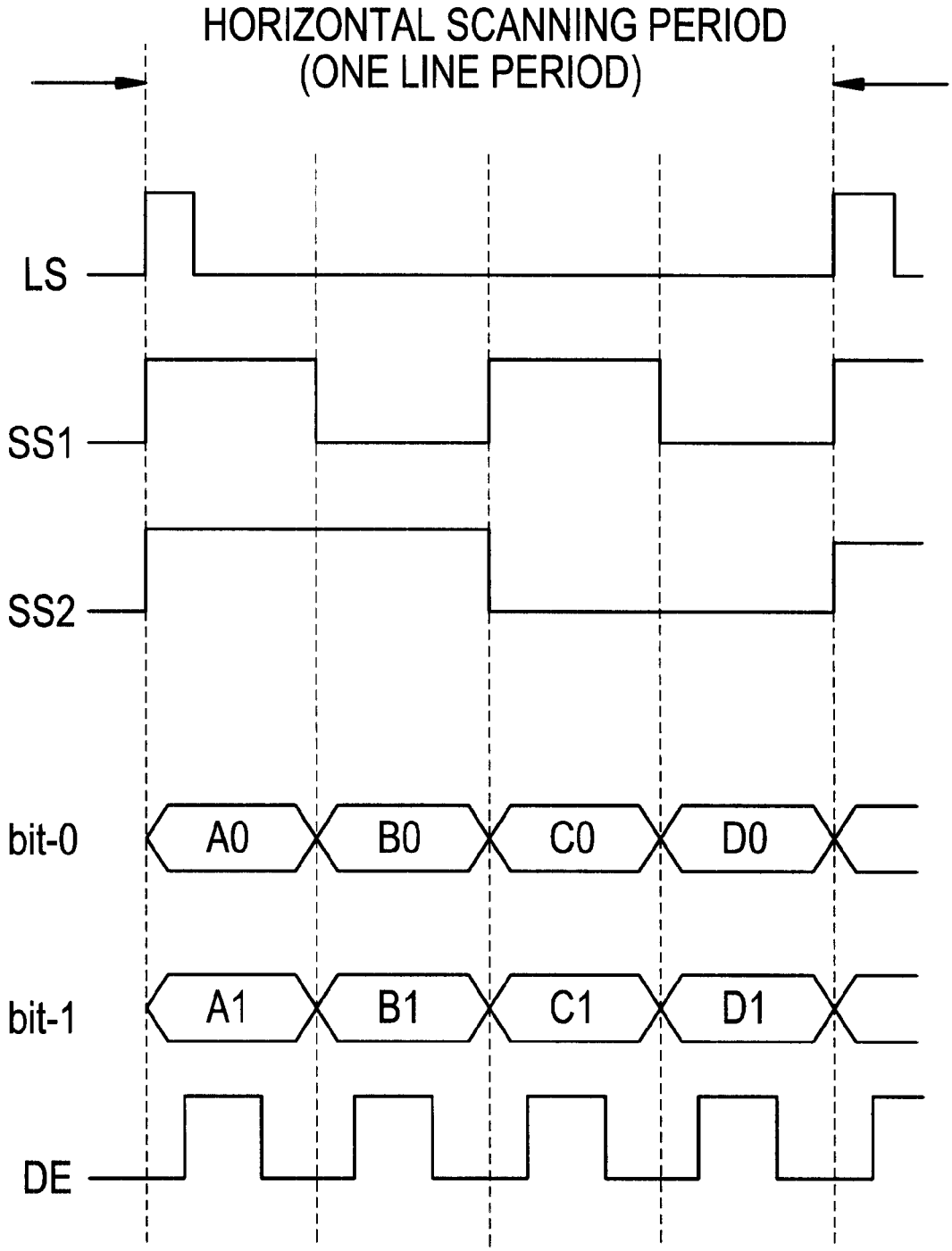
FIG. 18 is a timing chart of a selector circuit (switch circuit) according to an embodiment of the present invention.

FIG. 18 shows timing charts of 2-bit data and timing signals inputted into the selector circuit (1) 1506 and the selector circuit (2) 1509. Reference character LS denotes a latch signal, and is a signal supplied to the latch circuit (2) 1505 at the start of one line period (horizontal scanning period). Reference characters bit-0 and bit-1 denote zeroth bit and first bit data of the digital picture signal outputted from the latch circuit (2) 1505. Here, it is assumed that digital signals A1 and A0 are supplied to the signal lines L0.1 and L0.0 from the latch circuit (2) 1505 connected to the selector circuit (1) 1506 shown in FIG. 16, digital signals B1 and B0 are supplied to the signal lines L1.1 and L1.0, digital signals C1 and C0 are supplied to the signal lines L2.1 and L2.0, and digital signals D1 and D0 are supplied to the signal lines L3.1 and L3.0

In the selector circuit (1) 1506, on the basis of the timing signals supplied to SS1 and SS2, signals outputted to bit-1 and bit-0 are selected. That is, in the first (¼) line period, A1 is outputted to bit-1, and A0 is outputted to bit-0. In the next (¼) line period, B1 is outputted to bit-1 and B0 is outputted to bit-0. In the next (¼) line period, C1 is outputted to bit-1, and C0 is outputted to bit-0. In the last (¼) line period, D1 is outputted to bit-1, and D0 is outputted to bit-0. Like this, data from the latch circuit (2) are supplied to the level shifter circuit every (¼) line period.

As an example of D/A conversion circuits capable of being used for the D/A conversion circuit 1508, there can be cited D/A conversion circuits disclosed in Japanese Application No. Hei. 9-344351 and No. Hei. 9-365054 by the same assignee as the present application. In the D/A conversion circuits disclosed in these patent applications, as described above, digital video data are divided into an upper bit and a lower bit, and an analog picture signal is formed by using two D/A conversion circuits. For example, in the case where 4-bit digital video data are used, the data may be divided into upper two bits and lower 2 bits to perform D/A conversion.

The analog picture signals supplied from the D/A conversion circuit are selected by the selector circuit (2) 1509, and are supplied to the source signal line. Also in this case, although the analog picture signals are supplied to the corresponding source signal lines for every (¼) line period, the analog picture signals are supplied to the source signal lines only in the period when the voltages of the analog signals are completely determined by decode enable signals (DE).

Incidentally, in this embodiment, although 2-bit digital video data are processed, digital video data of more than 2-bit may be processed.

In this embodiment, since one D/A conversion circuit is provided for every four source signal lines, the number of D/A conversion circuits is made one fourth of the prior art by using a switch circuit. However, in the present invention, the number of D/A conversion circuits may be changed to other number. For example, in the case where one D/A conversion circuit is assigned to eight source signal lines, in the semiconductor display device of this embodiment, the number of D/A conversion circuits becomes 240, so that further reduction in the area of the driving circuit can be realized. Like this, it is not limited to this embodiment how many source signal lines are assigned one D/A conversion circuit.

Thus, in the case where the semiconductor display device of the present invention has m source signal lines (m is a natural number) (in other words, in the case where the number of pixels (horizontal×vertical) is m×arbitrary number), m x-bit digital gradation signals (x is a natural number) is supplied for one line. In this case, if the semiconductor display device of the present invention includes a D/A conversion circuit portion having n D/A conversion circuits (n is a natural number), each of the D/A conversion circuits sequentially converts m/n digital gradation signals into analog signals, and supplies the analog signals to the corresponding m/n source lines. Incidentally, it is appropriate to use the D/A conversion circuits according to the number of bits of the digital gradation signal.

According to this embodiment, the number of D/A conversion circuits, which occupys a large area in the driving circuit, can be made one fourth of the prior art, even if the increase of the selector circuit is taken into consideration, miniaturization of the semiconductor display device can be realized.

Embodiment 6

Although the transmission type liquid crystal panel has been described in the embodiments 2 to 5, it is needless to say that the driving circuit of the embodiment 1 can be applied to a reflection type liquid crystal panel as well. Moreover, a ferroelectric liquid crystal, an antiferroelectric liquid crystal, or the like may be used for a liquid crystal material.

Further, although the liquid crystal is used for the display medium in the foregoing embodiments 2 to 5, the driving circuit of the embodiment 1 can be used for a mixed layer of a liquid crystal and high polymer, a so-called polymer dispersion type liquid crystal display device. Moreover, the driving circuit of the embodiment 1 may be used for any display device having any other display medium in which optical characteristics can be modulated in response to an applied voltage. For example, an electroluminescence element, an electrochromism element, and the like may be used for a display device.

Embodiment 7

The semiconductor display devices of the foregoing embodiments 1 to 6 have various uses. In this embodiment, semiconductor devices incorporating the semiconductor display devices of the present invention will be described.

As such semiconductor devices, a video camera, a still camera, a projector, a head mount display, a car navigation system, a personal computer, a portable information terminal (mobile computer, portable telephone, etc.) and the like are enumerated. FIGS. 13A to 13F show examples of those semiconductor devices.

Figure 13A:
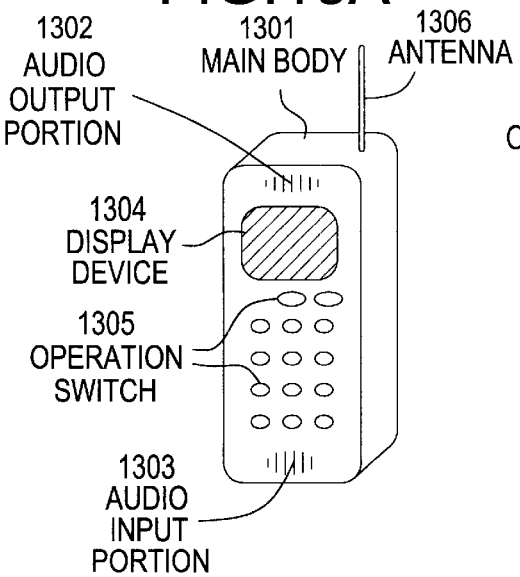
FIGS. 13A to 13F show examples of semiconductor devices provided with semiconductor display devices of the present invention.

FIG. 13A shows a portable telephone which is constituted by a main body 1301, an audio output portion 1302, an audio input portion 1303, a semiconductor display device 1304, an operation switch 1305, and an antenna 1306.

Figure 13B:
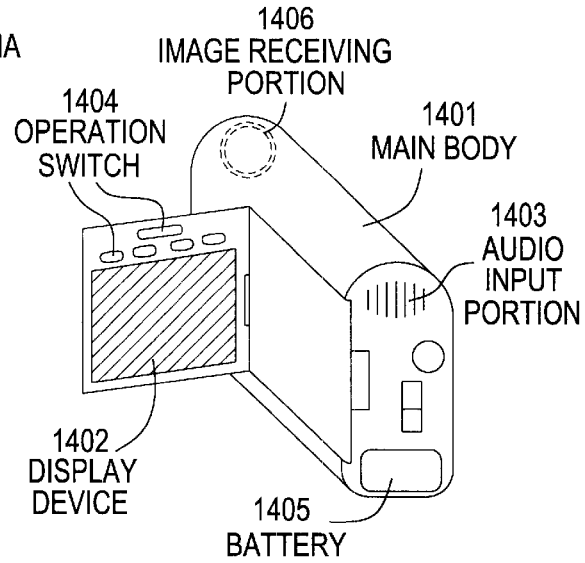

FIG. 13B shows a video camera which is constituted by a main body 1401, a semiconductor display device 1402, an audio input portion 1403, an operation switch 1404, a battery 1405, and an image receiving portion 1406.

Figure 13C:
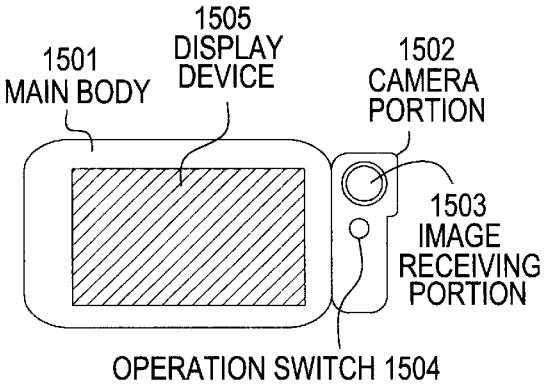

FIG. 13C shows a mobile computer which is constituted by a main body 1501, a camera portion 1502, an image receiving portion 1503, an operation switch 1504, and a semiconductor display device 1505.

Figure 13D:
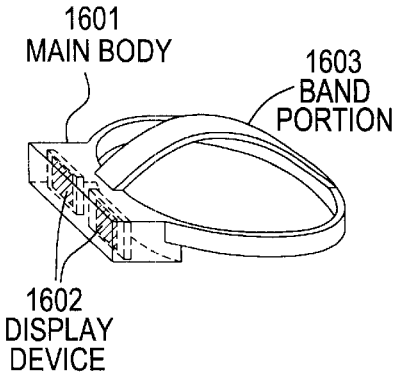

FIG. 13D shows a head mount display which is constituted by a main body 1601, a semiconductor display device 1602, and a band portion 1603.

Figure 13E:
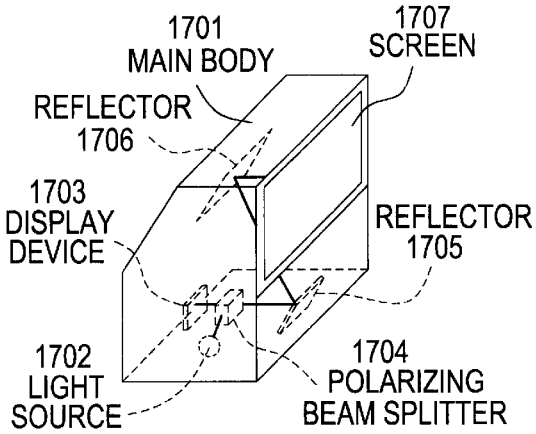

FIG. 13E shows a rear type projector which is constituted by a main body 1701, a light source 1702, a semiconductor display device 1703, a polarizing beam splitter 1704, reflectors 1705 and 1706, and a screen 1707. Incidentally, in the rear type projector, it is preferable that the angle of the screen can be changed according to the position of a viewer while the main body is fixed.

Figure 13F:
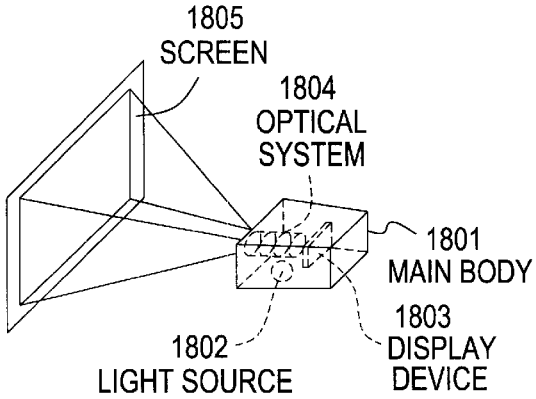

FIG. 13F shows a front type projector which is constituted by a main body 1801, a light source 1802, a semiconductor display device 1803, an optical system 1804, and a screen 1805.

According to the semiconductor display device of the present invention, since the number of D/A conversion circuits which occupys a large area in the driving circuit, can be largely reduced as compared with the prior art, miniaturization of a semiconductor display device can be realized.

What is claimed is:

1. A display device, comprising:

a memory circuit for storing m x-bit digital gradation signals (m and x are natural numbers); and a D/A conversion circuit portion for converting said m x-bit digital gradation signals supplied from said memory circuit into analog signals and for supplying said analog signals to m source signal lines, said D/A conversion circuit portion comprising n D/A conversion circuits where n is a natural number, wherein input of each of said n D/A conversion circuits is connected with outputs of m/n x-input NANDs, wherein each of inputs of said x-input NANDs is connected with an output of y-input NAND where y is two or more, and wherein each of said n D/A conversion circuits sequentially converts the m/n x-bit digital gradation signals into m/n analog signals to supply said m/n analog signals to corresponding m/n source signal lines.

2. A device according to claim 1, wherein the memory circuit includes a plurality of latch circuits.

3. A device according to claim 1 wherein each of said n D/A conversion circuits comprises a thin film transistor provided over a substrate.

4. A device according to claim 3 further comprising a pixel thin film transistor provided over said substrate.

5. A device according to claim 1 wherein said display device is a liquid crystal display.

6. A device according to claim 1 wherein said display device is an electroluminescence display.

7. A device according to claim 1 wherein said display device is an electrochromism display.

8. A device according to claim 1 wherein said display device is incorporated into a video camera.

9. A device according to claim 1 wherein said display device is incorporated into a still camera.

10. A device according to claim 1 wherein said display device is incorporated into a projector.

11. A device according to claim 1 wherein said display device is incorporated into a head mount display.

12. A device according to claim 1 wherein said display device is incorporated into a car navigation system.

13. A device according to claim 1 wherein said display device is incorporated into a personal computer.

14. A device according to claim 1 wherein said display device is incorporated into a portable information terminal.

15. A device according to claim 1 wherein said display device is incorporated into a mobile computer.

16. A device according to claim 1 wherein said display device is incorporated into a portable telephone.

17. A device according to claim 1 wherein said memory circuit comprises a latch circuit.

18. A method of driving a display device comprising:

storing m x-bit digital gradation signals where m and x are natural numbers;

sequentially converting the m/n x-bit digital gradation signals into m/n analog signals in one line period by each of n D/A conversion circuits to supply said m/n analog signals to corresponding m/n source signal lines where n is a natural number, wherein said n D/A conversion circuits supplies the n analog signals to n source signal lines in a same timing.

19. A method according to claim 18 wherein each of said n D/A conversion circuits comprises a thin film transistor provided over a substrate.

20. A method according to claim 19 further comprising a pixel thin film transistor provided over said substrate.

21. A method according to claim 18 wherein said display device is a liquid crystal display.

22. A method according to claim 18 wherein said display device is an electrol uminescence display.

23. A method according to claim 18 wherein said display device is an electrochromism display.

24. A method according to claim 18 wherein said display device is incorporated into one selected from the group consisting of a portable telephone, a video camera, a mobile computer, a head mount display, a rear type projector, and a front type projector.

25. A method of driving a display device comprising:

sampling and storing m x-bit digital gradation signals by a timing signal from a shift register where m and x are natural numbers;

sequentially converting the m/n x-bit digital gradation signals into m/n analog signals by each of n D/A conversion circuits to supply said m/n analog signals to corresponding m/n source signal lines where n is a natural number, wherein said n D/A conversion circuits supplies the n analog signals to n source signal lines in a same timing.

26. A method according to claim 25 wherein each of said n D/A conversion circuits comprises a thin film transistor provided over a substrate.

27. A method according to claim 26 further comprising a pixel thin film transistor provided over said substrate.

28. A method according to claim 25 wherein said display device is a liquid crystal display.

29. A method according to claim 25 wherein said display device is an electroluminescence display.

30. A method according to claim 25 wherein said display device is an electrochromism display.

31. A method according to claim 25 wherein said display device is incorporated into one selected from the group consisting of a portable telephone, a video camera, a mobile computer, a head mount display, a rear type projector, and a front type projector.

* * * * *